US012426756B2

(12) United States Patent
Hafenrichter et al.

(10) Patent No.: US 12,426,756 B2
(45) Date of Patent: Sep. 30, 2025

(54) SUCTION DEVICE

(71) Applicant: Festool GmbH, Wendlingen (DE)

(72) Inventors: Rainer Hafenrichter, Buch (DE); Jan Kopf, Ulm (DE)

(73) Assignee: FESTOOL GMBH, Wendlingen (DE)

( * ) Notice: Subject to any disclaimer, the term of this patent is extended or adjusted under 35 U.S.C. 154(b) by 518 days.

(21) Appl. No.: 17/890,320

(22) Filed: Aug. 18, 2022

(65) Prior Publication Data

US 2023/0076782 A1 Mar. 9, 2023

(30) Foreign Application Priority Data

Aug. 20, 2021 (DE) ..... 10 2021 121 707.5

(51) Int. Cl.

| | |
|---|---|
| ***A47L 9/28*** | (2006.01) |
| ***A47L 9/12*** | (2006.01) |
| ***A47L 9/22*** | (2006.01) |

(52) U.S. Cl.

CPC ..... *A47L 9/2889* (2013.01); *A47L 9/12* (2013.01); *A47L 9/22* (2013.01); *A47L 9/2821* (2013.01); *A47L 9/2842* (2013.01)

(58) Field of Classification Search

CPC . A47L 9/2889; A47L 9/12; A47L 9/22; A47L 9/2821; A47L 9/2842

See application file for complete search history.

(56) References Cited

U.S. PATENT DOCUMENTS

| | | | |
|---|---|---|---|
| 2004/0103493 A1 | 6/2004 | Moore et al. | |
| 2006/0080804 A1 | 4/2006 | Hisano et al. | |
| 2009/0193612 A1* | 8/2009 | Weiss | A47L 9/20 15/347 |

(Continued)

FOREIGN PATENT DOCUMENTS

| | | |
|---|---|---|
| DE | 692 16 716 T2 | 5/1997 |
| DE | 10 2009 015 641 A1 | 9/2010 |

(Continued)

OTHER PUBLICATIONS

European Search Report of Jan. 13, 2023.

*Primary Examiner* — Andrew A Horton
(74) *Attorney, Agent, or Firm* — Hoffmann & Baron, LLP

(57) ABSTRACT

A suction device with a suction device housing (20), in which a suction turbine (11) for generating a suction flow (S) is arranged, the suction turbine (11) having a suction turbine inflow opening (11A), through which the suction flow (S) can flow into the suction turbine (11) and at least one suction turbine outflow opening (11B), through which the suction flow (S) can flow out of the suction turbine (11), wherein the suction device housing (20) has a suction inlet (12) for letting in the suction flow (S) and a dust collecting chamber (21) for collecting dust contained in the suction flow (S), wherein a filter element (13) for retaining dust in the dust collecting chamber (21) is arranged between the dust collecting chamber (21) and a suction turbine inflow opening (11A) of the suction turbine (11). The suction turbine inflow opening (11A) of the suction turbine (11) is connected to at least one cooling air duct (99, 100, 101), which has a duct inflow opening (97A, 98A, 102) through which cooling air (KL) from an area surrounding the suction device (10) can flow past the filter element (13) to the suction turbine (11).

26 Claims, 10 Drawing Sheets

(56) References Cited

U.S. PATENT DOCUMENTS

| | | | |
|---|---|---|---|
| 2012/0159736 | A1 | 6/2012 | Huber et al. |
| 2017/0245717 | A1 | 8/2017 | Son et al. |

FOREIGN PATENT DOCUMENTS

| | | | |
|---|---|---|---|
| DE | 10 2010 064 026 | | 6/2012 |
| DE | 10 2010 064 026 | A1 | 6/2012 |
| DE | 10 2011 052 023 | | 1/2013 |
| DE | 10 2011 052 023 | A1 | 1/2013 |
| DE | 10 2012 207 348 | | 11/2013 |
| DE | 10 2012 207 348 | A1 | 11/2013 |
| DE | 10 2013 012 240 | | 1/2015 |
| DE | 10 2013 012 240 | A1 | 1/2015 |
| DE | 10 2013 012 242 | | 1/2015 |
| DE | 10 2013 012 242 | A1 | 1/2015 |

* cited by examiner

SUCTION DEVICE

BACKGROUND OF THE INVENTION

The invention relates to a suction device with a suction device housing in which a suction turbine for generating a suction flow is arranged, the suction turbine having a suction turbine inflow opening through which the suction flow can flow into the suction turbine and at least one suction turbine outflow opening through which the suction flow can flow out of the suction turbine, wherein the suction device housing has a suction inlet for letting in the suction flow and a dust collecting chamber for collecting dust contained in the suction flow, wherein a filter element for retaining dust in the dust collecting chamber is arranged between the dust collecting chamber and a suction turbine inflow opening of the suction turbine.

Such a suction device is explained, for example, in DE 10 2013 012 240 A1. The suction device is designed in the manner of a stacking container and can be stacked on a lower container. In addition, further containers, in particular a container attachment for receiving a suction hose of the suction device, can be stacked on top of the suction device. The suction device is extremely compact, so that the surfaces of the housing available for cooling are small. Usually, the suction flow is usually sufficient for sufficient cooling, in particular of the suction turbine, but in some situations the cooling is critical.

SUMMARY OF THE INVENTION

It is therefore the object to provide a suction device with an improved cooling concept.

To solve the problem, a suction device of the type mentioned at the outset provides for the suction turbine inflow opening of the suction turbine to be connected to at least one cooling air duct, which has a duct inflow opening, via which cooling air can flow from an area surrounding the suction device past the filter element to the suction turbine.

It is a basic idea of the present invention that when the flow cross-section for the so-called normal suction flow is not available or is available to a lesser extent, sufficient cooling air is still available for cooling the suction turbine.

For example, the suction turbine is such a suction turbine that is or can be cooled by the suction flow it conveys. In particular, the suction turbine is a so-called flow-through turbine.

The duct inflow opening is an inflow opening separate from the suction inlet. It is therefore possible for the suction turbine to receive air or cooling air via the duct inflow opening and the at least one cooling air duct even if no suction air or little suction air can flow in via the suction inlet. As a result, adequate cooling of the suction turbine is always possible.

A plurality of cooling air ducts can be provided, each of which has a separate duct inflow opening and/or a separate duct outflow opening which is flow-connected to the suction turbine inflow opening. For example, it can be provided that the suction device has at least two, preferably three, cooling air ducts, of which each cooling air duct has a separate duct inflow opening and/or separate duct outflow opening.

Provision is advantageously made for at least two cooling air ducts to have separate duct inflow openings and to have at least one common duct portion. However, it is also possible for two cooling air ducts to have a common duct portion which leads to a duct inflow opening provided for both cooling air ducts or to a duct outflow opening provided for both ducts.

The duct inflow opening and/or a flow cross section of the at least one cooling air duct are preferably permanently open. The flow cross section of the cooling air duct is therefore always completely available for the cooling air or the cooling air flow to flow through. The at least one cooling air duct or its duct inflow opening advantageously has no valve.

However, an embodiment is possible in which at least one cooling air duct has a permanently open flow cross section, while another cooling air duct has a valve, in particular a pressure-dependent valve. The pressure-dependent valve adjusts the flow cross-section, for example the flow cross-section of the duct inflow opening, as a function of a negative pressure and completely frees the flow cross-section, for example starting from a predetermined threshold value of the negative pressure. If, for example, the negative pressure in the at least one cooling air duct increases because the suction inlet is not available or is available to a lesser extent, this pressure-dependent valve can release the duct inflow opening for the cooling air flow to flow through.

It is advantageously provided that the duct inflow opening of the at least one cooling air duct is arranged on an outer wall, in particular on an outer edge region, of the suction device housing. The cooling air can thus flow directly from the environment into the at least one cooling air duct. For example, it is advantageous if the duct inflow opening is arranged on a lower side edge of the suction device housing.

It is also advantageous if a protective grille is arranged on the duct inflow opening. The protective grille can have one or more grid struts or grid bars.

It is preferably provided that the duct inflow opening and/or an air outlet through which the suction flow can flow out of the suction device housing are arranged on side walls of the suction device housing, which extend between a bottom wall and a top wall of the suction device housing. Thus, the duct inflow opening or the air outlet are not covered if the bottom wall or the top wall are covered by, for example, by a container stacked underneath the suction device housing or stacked on top of the suction device housing.

A preferred variant of the invention provides that the at least one cooling air duct has a duct portion which, in order to cool an electrical component that is separate from the suction turbine, runs past this electrical component. It is particularly advantageous if the cooling air flow flows around the electrical component. For example, the electrical component is or the electrical component includes an energization device for energizing the suction turbine. In this case, provision is made, for example, for the at least one cooling air duct to have a duct portion which, in order to cool an energization device for energizing the suction turbine, runs past the energization device. The energization device has, for example, one or more electronic power components, for example thyristors, Mosfets or the like, which are effectively cooled by the cooling air flow.

The cooling air duct can be open, so to speak, in the area of the electrical component, or the electrical component can extend through the cooling air duct. In this way, the cooling air can, so to speak, wash or flow around the electrical component. The suction turbine ensures a constant flow of cooling air, which cools the electrical component.

There can be several cooling air ducts, one of which leads past an electrical component, while another cooling air duct is not provided for cooling the electrical component or an electrical component, but exclusively for cooling the suction turbine.

However, the electrical component can also be an electrical energy storage, for example, which will become even clearer below.

It is advantageous for the suction device to have an energy storage receptacle for at least one electrical energy storage device that can be detachably connected to the suction device, on which a device interface with a contact arrangement for establishing an electrical connection to the electrical energy storage device is arranged. Thus, the suction device can also be operated without an external electrical power supply. The energy storage is advantageously part of the suction device, but can be detached from the suction device. The energy storage is, for example, a so-called battery pack. However, the energy storage can also be part of a system that includes the suction device and the energy storage. Two energy storages are preferably provided. The suction device advantageously has two device interfaces for connecting two energy storages.

Cooling using the at least one cooling air duct brings particular advantages in connection with such an energy storage device, because space is required within the suction device housing for the at least one electrical energy storage device if the energy storage device is not to protrude in front of the housing or is to be arranged outside of the housing. If the suction device housing is then particularly compact, for example because it is designed as a stacking container or stacking housing, the space available for the suction turbine and the other electrical components is small, which is why effective cooling has particular advantages.

Cooling of the at least one electrical energy storage using one or more cooling air ducts is also advantageous. An advantageous concept provides, for example, that the duct inflow opening of the at least one cooling air duct is arranged on the energy storage receptacle, so that cooling air can flow past the energy storage received in the energy storage receptacle into the duct inflow opening. A plurality of duct inflow openings can also be arranged on the energy storage receptacle, or the energy storage receptacle can be cooled using a plurality of cooling air ducts.

A preferred concept provides that the at least one energy storage device has a fan for generating a cooling air flow that cools the energy storage device, with an energy storage device housing of the energy storage device having an energy storage device inflow opening for the cooling air flow to flow into an interior space of the energy storage device housing and an energy storage device outflow opening for outflow of the cooling air flow from the interior of the energy storage housing. The energy storage thus has active cooling, so to speak. The heated air expelled from the energy storage can be effectively discharged through the aforementioned at least one duct inflow opening on the energy storage receptacle.

An advantageous arrangement of the duct inflow opening provides that the duct inflow opening of the at least one cooling air duct is arranged on the energy storage device receptacle such that the energy storage device outflow opening of the energy storage device is directly opposite the duct inflow opening when the energy storage device is arranged in the receptacle of the suction device. For example, the energy storage outflow opening is arranged on a top wall of an energy storage housing, which is opposite a side wall of the energy storage receptacle, on which in turn the duct inflow opening is arranged. A cooling air flow flowing out of the energy storage outflow opening can thus flow directly into the duct inflow opening of the at least one cooling air duct.

It is advantageously provided that the duct inflow opening of the at least one cooling air duct is arranged directly next to the contact arrangement of the device interface of the energy storage receptacle. In this context, it should be added that the energy storage outflow opening is advantageously arranged directly next to the contact arrangement of the energy storage interface of the energy storage.

The inflow of cooling air into the energy storage is facilitated, for example, by the measures explained below.

It is advantageously provided that the energy storage inflow opening of the at least one energy storage is arranged in the region of an insertion opening of the energy storage receptacle provided for inserting the energy storage into the energy storage receptacle when the energy storage is arranged in the energy storage receptacle. The cooling air can flow into the energy storage, for example, via the insertion opening.

The duct inflow opening of the at least one cooling air duct is preferably arranged on a longitudinal end region of the energy storage receptacle that is opposite to the insertion opening. For example, the duct inflow opening is arranged in the vicinity of a bottom of the energy storage receptacle.

The energy storage receptacle advantageously has two device interfaces to which an energy storage can be connected in each case. The course is when each device interface has a separate receiving outflow opening or duct inflow opening of a cooling air duct, through which cooling air for cooling the energy storage arranged at the respective device interface can flow out. The device interfaces are preferably arranged on opposite side walls of the energy storage receptacle. At least one receiving outflow opening or duct inflow opening of a cooling air duct is preferably arranged on each of these side walls.

An advantageous concept provides that the suction device comprises a tubular body or a cooling air hose, in which the at least one cooling air duct runs at least in portions or which forms the cooling air duct. The tubular body is flexible, for example, and has a cooling air hose or is designed as a cooling air hose. However, rigid, non-flexible tubular bodies can also be provided. Furthermore, it is possible for the cooling air duct to run through a rigid tubular body and a cooling air hose. The cooling air can be guided in a targeted manner using the tubular body or cooling air hose.

At this point, however, it should be mentioned that the suction device housing or wall sections arranged in the suction device housing can delimit the at least one cooling air duct or duct portion of the cooling air duct completely or in portions.

It is advantageous if the tubular body or cooling air hose runs past and/or passes through a suction turbine receiving space in which the suction turbine is received and/or an energy storage receptacle on which at least one energy storage device for supplying power to the suction device can be arranged. The cooling air hose can thus run, for example, through the suction turbine receiving space or the energy storage receptacle, with the cooling air flow being guided in the cooling air hose and thus not flowing out into the suction turbine receiving space or the energy storage receptacle, but rather flowing through the aforementioned components. However, it is also possible for the cooling air hose to pass by the suction turbine receiving space or the energy storage receptacle. It is also possible for the cooling air hose to have portions, one of which passes through the suction turbine receiving space and/or the energy storage receptacle, while another portion of the cooling air hose leads past the suction turbine receiving space or the energy storage receptacle.

The suction turbine is advantageously received in a suction turbine receiving space of the suction device housing. The suction turbine inflow opening is arranged on a wall of a suction turbine receiving space. There is preferably a passage on the wall which is flow-connected to the suction turbine inflow opening. It is advantageous if there is a seal between the suction turbine inflow opening and the passage, so that the air flowing through the passage, for example the suction flow and at least one cooling air flow, does not flow into the suction turbine receiving space, but into the suction turbine inflow opening.

The suction turbine receiving space is flow-connected to an air outlet through which the suction flow generated by the suction turbine and the cooling air flow of the at least one cooling air duct can flow out. The air outlet is preferably arranged on a wall of the suction turbine receiving space. Preferably, this wall is an outer wall of the suction device housing. It is therefore possible for the suction turbine to eject air into the suction turbine receiving space via one or more suction turbine outflow openings, with this air being able to flow out of the suction turbine receiving space via the air outlet.

Provision is advantageously made for the at least one cooling air duct to open out at an outflow opening which is arranged between the filter element and the suction turbine inflow opening.

Furthermore, it is advantageous if at least two cooling air ducts have outflow openings that are separate from one another, via which the cooling air can flow from the respective cooling air duct to the suction turbine inflow opening. If several cooling air ducts are provided, it is advantageous if they each open out at separate outflow openings in the intermediate space between the filter element and the suction turbine inflow opening.

It is certainly possible for two or more cooling air ducts to have the same flow cross sections. However, it is preferred if the suction device has at least two cooling air ducts which have different flow cross sections. It is advantageously possible, for example, for a cooling air duct provided for cooling one or more energy storages to have a smaller flow cross section than a cooling air duct provided for cooling the power supply device of the suction device. It is also possible for a cooling air duct with a small flow cross section to open into a cooling air duct with a larger flow cross section. It is also possible for two cooling air ducts to have a common duct portion whose flow cross section is larger than a flow cross section of duct portions of the cooling air ducts that are separate from one another.

It is also advantageously provided that the suction device has a controller for controlling the suction turbine, with the controller being designed to determine a volume flow of the suction flow and/or a flow rate of the suction flow using a motor characteristic of a drive motor of the suction turbine, with the motor characteristic representing a current profile of the drive motor as a function of a supply voltage applied to the drive motor. The suction power of the suction turbine is proportional to the electrical power of the drive motor of the suction turbine. The electrical power corresponds to the product of the voltage applied to the suction turbine and the current flowing through the suction turbine. The suction power of the suction turbine can thus be determined by the controller using the motor characteristic. The suction power in turn correlates with the flow rate. The controller can thus use the motor characteristic to determine whether a suction power and/or flow rate of the suction device that is sufficient for suction of, for example, grinding dust when grinding a workpiece is available.

It is expedient if the motor characteristic curve in the area of the volume flow to be determined and/or the flow rate of the inflow to be determined has a changing and/or essentially linear profile due to the cooling air constantly flowing in via the at least one cooling air duct. In contrast to the presence of a pressure-dependent valve on the at least one cooling air duct, there is a quasi-constant flow of cooling air, so that the motor characteristic curve is available as a reliable instrument for determining the flow rate and/or the suction power for the controller.

An advantageous concept provides that the controller is designed to output at least one acoustic and/or visual warning when the motor characteristic falls below a predetermined threshold value that is associated with a minimum volume flow and/or a minimum flow rate of the suction flow. For example, the suction device has optical output means, for example a display, LEDs or the like, and/or acoustic output means, for example a loudspeaker, for outputting the warning.

The suction device housing is preferably designed as a stacking housing designed to form a housing stack extending in the direction of a stacking axis, under which at least one stacking container can be stacked and/or on which at least one stacking container can be stacked. The stacking container is another suction device, for example. However, it is also possible for the stacking container to be, for example, a transport container for a machine tool, in particular for an abrasive and/or cutting machine tool, for example a grinding machine or sawing machine. The dust or particles that occur during operation of the grinding machine or sawing machine can be sucked up using the suction device.

It is possible to loosely stack the suction device housing on a stacking container, so to speak, or to stack a stacking container on the suction device housing. The stacking housing and the further stacking container can, however, optionally engage one another in a form-fitting manner using form-fitting contours arranged on the stacking housing of the vacuum cleaner and the stacking container, so that they hold one another in a form-fitting manner transversely to the stacking axis. For this purpose, for example, feet can be arranged on one stacking container or stacking housing and receptacles for the feet can be arranged on the other stacking container or stacking housing supporting or receiving the feet and engaging in one another in a form-fitting manner.

It is advantageous for the suction device to have coupling means for coupling the suction device housing to a stacking container that is stacked over or stacked underneath along the stacking axis, with the coupling means of the suction device housing the suction device being designed to interact with coupling means of the stacking container, so that the suction device housing is firmly connected to the stacking container transversely to the stacking axis and parallel to the stacking axis using the coupling means. The coupling means advantageously comprise rear gripping contours arranged on the stacking container and stacking housing, which can be engaged and disengaged from one another transversely to the stacking axis. Furthermore, the coupling means can comprise, for example, one or more locking elements, in particular at least one pivot bolt and at least one latching projection with which the pivot bolt can be brought into engagement.

Advantageously, the suction device comprises a container attachment, which can be stacked along the stacking axis as a stacking container on the suction device housing or underneath the suction device housing, wherein the container attachment and the suction device housing have the coupling means for firmly coupling the suction device housing to the container attachment in parallel and transverse to the stacking axis, and wherein the container attachment has a receiving space for at least one component, in particular a suction hose, of the suction device.

The container attachment preferably has a passage opening which is aligned with the suction inlet of the suction device housing when the container attachment is arranged on the suction device housing, the passage opening being provided and designed for pushing through and/or inserting a suction hose.

The suction device advantageously has a dust collection container which is arranged in the dust collecting chamber or which forms the dust collecting chamber and can be removed from the suction device housing and is in particular designed in the manner of a cassette. When the dust collection container is received in the housing, it faces the suction inlet. The suction flow flowing in via the suction inlet can thus flow into the dust collecting chamber of the dust collection container.

An energy storage provided for the power supply preferably comprises an energy storage housing, in the interior of which an arrangement of battery cells for providing electrical energy is arranged.

At least one device interface for detachable connection to an energy storage interface of the energy storage is provided on the housing of the suction device electrical device, the interfaces comprising contact arrangements for establishing electrical connections via the interfaces.

The energy storage housing has, for example, longitudinal side walls that extend between front side walls. The longitudinal side walls and the front side walls are arranged, for example, between a bottom wall and an interface wall, which lie opposite one another, and which, together with these walls, delimit an interior space of the energy storage housing.

The energy storage advantageously includes a fan for generating a cooling air flow, which can flow into the energy storage housing via an energy storage inflow opening and out of the energy storage housing via an energy storage outflow opening.

BRIEF DESCRIPTION OF THE DRAWINGS

An exemplary embodiment of the invention is explained below with reference to the drawing. In the figures.

DETAILED DESCRIPTION

Figure 1:
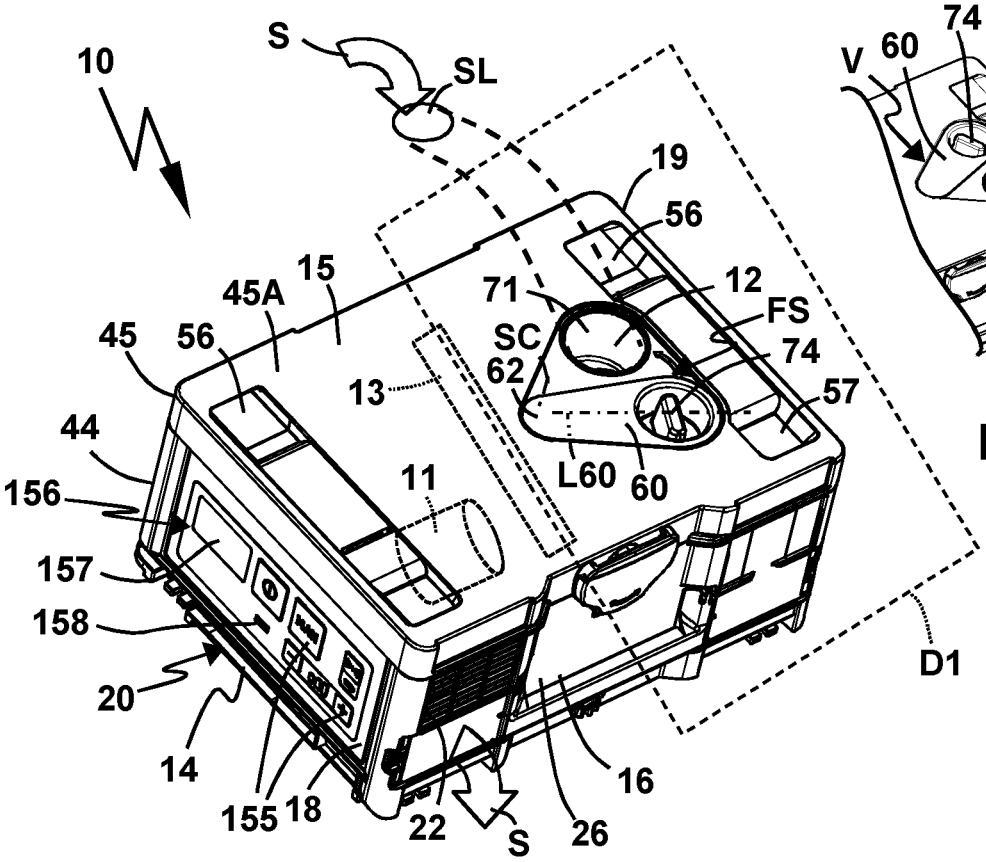
FIG. 1 shows a perspective oblique view of a suction device from above, with a suction inlet of the suction device being open.
Figure 2:
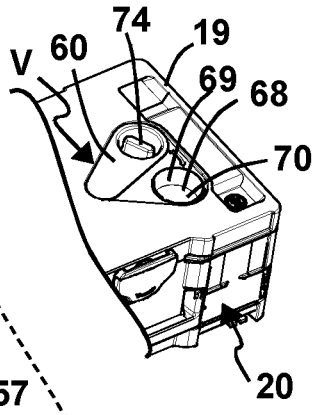
FIG. 2 shows a front part of the suction device according to FIG. 1, roughly corresponding to a detail D1 in FIG. 1, the suction inlet being closed by a closure element.
Figure 3:
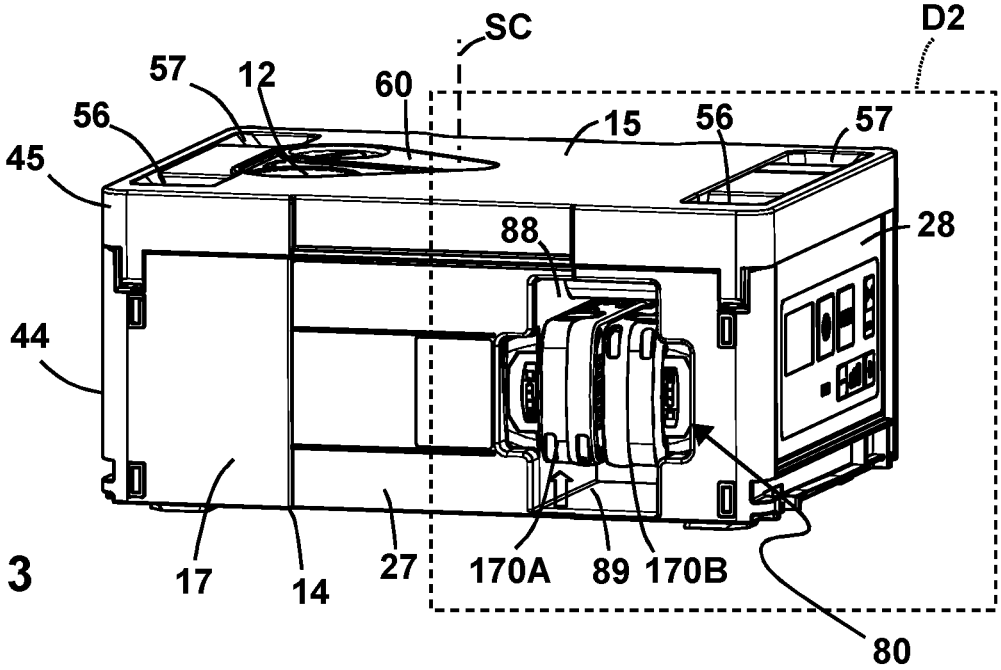
FIG. 3 shows a perspective rear view of the suction device according to FIGS. 1, 2.
Figure 4:
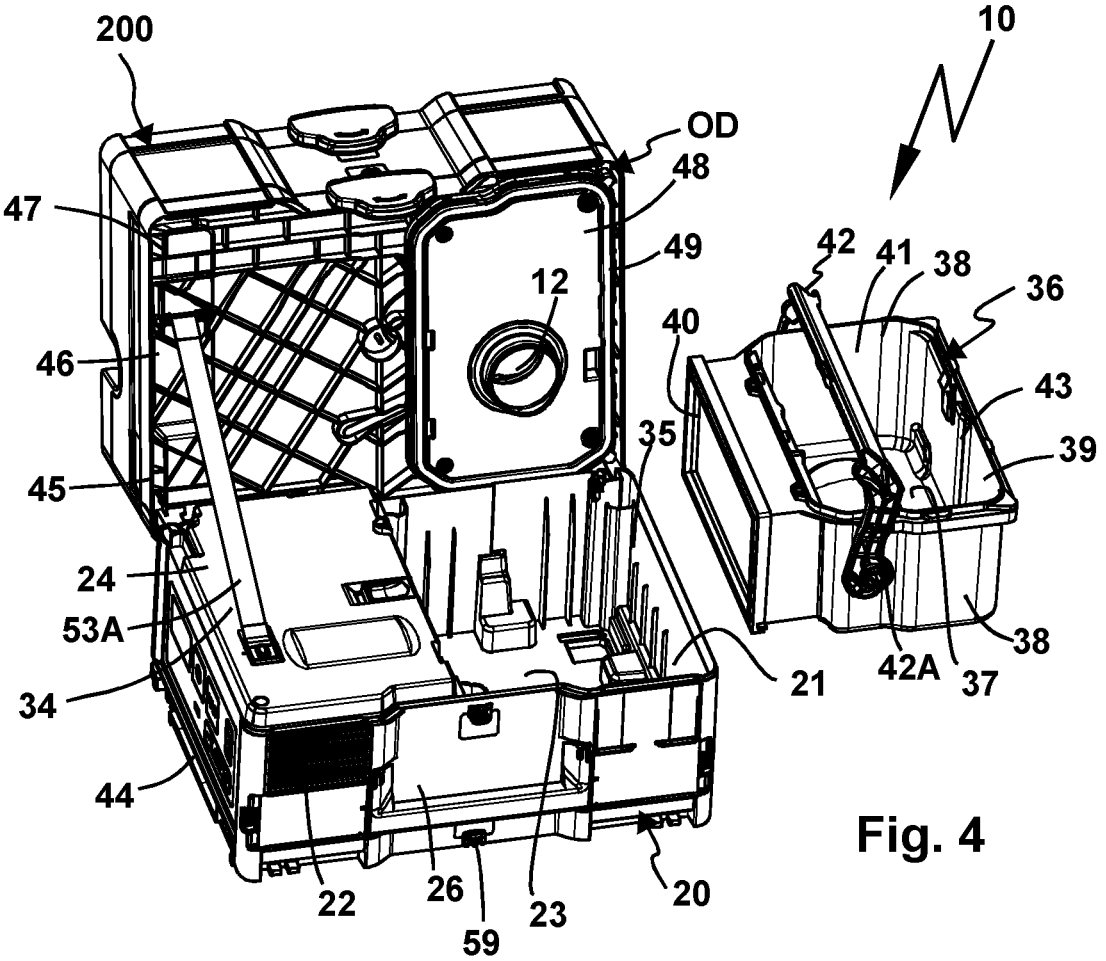
FIG. 4 shows the suction device according to the previous figures with the suction device housing being open and a removed dust collection container in a perspective oblique view from the front.
Figure 5:
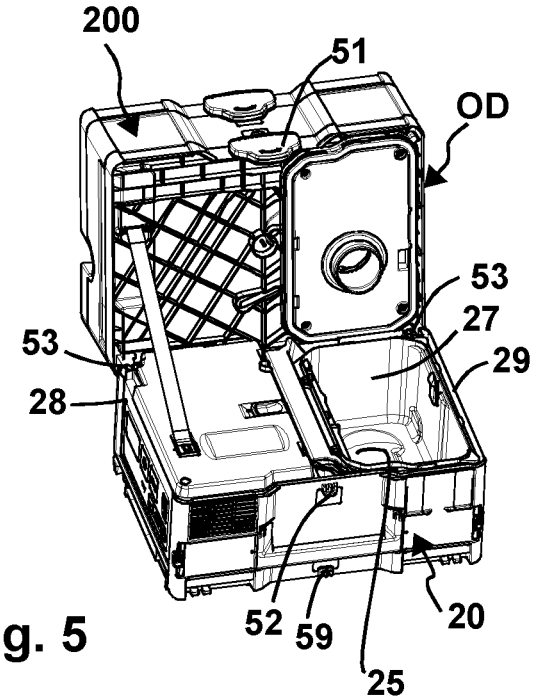
FIG. 5 shows the arrangement according to FIG. 4, with the dust collection container being received in the suction device housing of the suction device.

A suction device 10 has a suction device housing 20 in which a suction turbine 11 of the suction device 10 is received. A suction flow S can be generated with the suction turbine 11 and can flow into the suction device housing 20 through a suction inlet 12. A suction hose SL can be connected to the suction inlet 12.

The suction flow S flows through a dust collecting chamber 21 of the suction device housing 20, in which particles contained in the suction flow S, for example dust, can be collected. A filter element 13, for example a plate filter, is arranged between the suction turbine 11 and the dust collecting chamber 13, so that particles contained in the suction flow S are retained in the dust collecting chamber 21. The suction flow S flows through the suction turbine 11 downstream of the filter element 13 and flows out of the suction device housing 20 via an air outlet 22.

The suction device 10 is a mobile electrical device that can be conveniently brought to its place of use. The suction device body 20 is, for example, box-shaped and compact.

The suction device 10 can be set with its underside 14 on a surface. The suction inlet 12 is arranged on an upper side 15 of the suction device 10 opposite to the lower side 14. Between the lower side 14 and the upper side 15, the suction device 10 or its suction device housing 20 has longer longitudinal sides 16 and 17, of which the longitudinal side 16 forms a front side and the longitudinal side 17 forms a rear side of the suction device 10, for example.

In a housing interior 23 of the suction device housing 20, the dust collecting chamber 21 and a suction turbine part 24 are provided, in which the suction turbine 11 is received.

The suction device housing 20 comprises a bottom wall 25, from which peripheral walls protrude, namely front and rear longitudinal side walls 26, 27 on the longitudinal sides 16 and 17, and longitudinal side walls 28 and 29 on the longitudinal sides 18 and 19, which extend between the longitudinal side walls 26 and 27 and which together enclose the housing interior 23.

An intermediate wall 30 is arranged between the suction turbine part 24 and the dust collecting chamber 21 and divides the housing interior 23 into the suction turbine part 24 and the dust collecting chamber 21.

A through-flow opening 32 for the suction flow S is provided on the intermediate wall 30, through which the suction flow S can flow from the dust collecting chamber 21 in the direction of the suction turbine part 24, which has a suction turbine receiving space 31 in which the suction turbine 11 is received. The intermediate wall 30 could also be described as a bulkhead, which separates the suction turbine part 24 from the dust collecting chamber 21 apart from the through-flow opening 32 and other small outflow openings 98, 108 to be described.

The suction flow S flows out of the suction turbine receiving space 31 via the air outlet 22. The suction turbine part 24 and in particular the suction turbine receiving space 31 are closed by a covering wall 34, while the dust collecting chamber 21 is open on its side opposite the bottom wall 25, for example at the top in the position of use.

The air outlet 22 is arranged, for example, on one of the peripheral walls of the suction device housing 20, for example the front longitudinal side wall 26, although the longitudinal side walls 27 or 28 could also have an air outlet. In any case, it is advantageous if the air outlet 22 is not arranged on the bottom wall 25 and/or on the covering wall 34, both of which are possible in principle.

The dust collecting chamber 21 has a compartment 35 for a dust collection container 36. The dust collection container 36 is used to collect dirt. A filter bag can also be arranged in the dust collection container 36 or the dust collecting chamber 21.

The dust collection container 36 is designed, for example, as a type of cassette or module which can be removed from the suction device housing 20 in order, for example, to empty dust from the dust collection container 36.

The dust collection container 36 has a bottom wall 37, side walls 38 and 39 protruding from the bottom wall and a filter receptacle 40 for the filter element 13, which delimit an interior space 43 of the dust collection container 36. The filter element 13 is opposite the side wall 39. The side walls 38 extend between the filter receptacle 40 and the side wall 39. The side walls 38, 39 and an upper wall of the filter receptacle 40 delimit a receiving opening 41 which is opposite the bottom wall 37. Consequently, the dust collection container 36 is open at the top.

A carrying handle 42 in the manner of a strap is hinged to the side walls 38 by means of pivot bearings 42A, with which the dust collection container 36 can be gripped. When the carrying handle 42 is swung out, it can be grasped by an operator. When the dust collection container 36 is inserted into the receiving compartment 35, the carrying handle 42 can be pivoted in the direction of the filter receptacle 40 so that the carrying handle 42 does not project or only slightly project in front of the receiving opening 41.

Provision is advantageously made for the carrying handle 42 pivoted in the direction of the filter receptacle 40 to lock the dust collection container 36 in the receiving compartment 35. At the same time, the filter element 13 is expediently urged in the direction of the intermediate wall 30 so that a flow connection is established between the interior 43 of the dust collection container 36 and the flow opening 32 and thus the suction turbine 11 via the filter element 13.

The suction turbine part 24 and the dust collecting chamber 21 form part of a lower housing part 44 of the suction device housing 20. The lower housing part 44 can be closed by a cover 45. In the open state of the suction device housing 20 or in an open position OD of the cover 45, the storage compartment 35 is open in order to insert the dust collection container 36 into the storage compartment 35 or to remove it from it.

The cover 45 has a cover body, for example a covering wall 46 which includes a suction turbine portion 47 and a closure portion 48. The suction turbine portion 47 is assigned to the suction turbine part 24 and is located opposite the covering wall 34 when the cover 45 is in the closed state.

The closure portion 48 has a seal 49 with which the interior 43 of the dust collection container 36 can be closed. When the cover 45 is closed, the seal 49 rests, for example, on the end faces of the side walls 38 and 39 and on a side wall delimiting the filter receptacle 40, and in particular on these side walls 38, 39 and the outer circumference of the filter receptacle 40, so that the closure portion 48 tightly closes the dust collection container 36.

The cover 45 can be locked to the lower housing part 44 in a closed position SD of the cover 45 by means of a locking device 50.

The locking device 50 comprises a locking element 51 which is pivotably mounted on the cover 45 and which, in a locking position, engages with a locking element 52 on the lower housing part 44 and can be pivoted into a release position in which it disengages from the locking element 52. The locking element 51 is therefore designed in the manner of a swivel bolt. The locking element 52 is arranged on the longitudinal side wall 26 of the lower housing part 44. The locking element 52 is configured as a latching projection, for example. Corresponding to the front-side arrangement of the locking element 52, the locking element 51 is arranged on a front side of the cover 45 assigned to the front side or front longitudinal side 16 of the suction device 10.

The cover 45 is hinged to the lower housing part 44 by means of pivot bearings 53 and can be pivoted between its open position OD and its closed position SD. The pivot bearings 53 are arranged, for example, on the longitudinal side wall 27, in particular its upper end side or narrow side.

A strap 53A optionally present between the cover 45 and the lower housing part 44, which is fastened, for example, to the covering wall 34 and a wall surface of the closure portion 48 opposite thereto, limits the pivoting of the cover 45 in the direction of its open position OD.

Feet 54, 55 are arranged on the underside 14 of the suction device housing 20, with which the suction device housing 20 can be placed on a surface, but can also be brought into engagement with receptacles 56, 57 with a further suction device housing 20 of a similar suction device 10. The feet 54 and the receptacles 56 are arranged close to the rear longitudinal side wall 27. The receptacles 56 and the feet 54 have rear gripping contours 56A, 54A, which can be engaged and disengaged with one another transversely to a stacking direction or stacking axis SR and when they are engaged with one another, they can then connect in a tension-proof manner, suction device housings 20, which are stacked on top of one another along the stacking axis SR. The rear gripping contours 56A, 54A form components of coupling means 58. The coupling means 58 for coupling stacked containers or suction device housings 20 also include a locking element 59 which is arranged on the housing lower part 44 in the manner of the locking element 52, but not close to the free end face of the longitudinal side wall 26, but close to the bottom wall 25. Furthermore, the locking element 51 also forms part of the coupling means 58. When the locking element 51 of a respective lower container or suction device housing 20 is brought into engagement with the locking element 59 by the locking element 51 being pivoted, the containers or suction device housings 20 are also coupled to one another in the region of the front side or front longitudinal side 16 and thus a tension-proof connection of these suction device housings 20 is produced in the direction of the stacking axis SR or in the stacking direction.

The suction inlet 12 can be closed by a closure element 60.

The closure element 60 has a closure body 61 which can be inserted into the suction inlet 12. The closure body 61 is therefore designed as a plug-in projection or plug-in body.

The closure element 60 is movably mounted on the suction device housing 20 by means of a bearing 62 between a closed position V and a release position FS, the closure element 60 closing the suction inlet 12 in the closed position V and releasing it in the release position FS. In the release position FS, the suction inlet 12 is free or open for arranging, in particular for inserting, the suction hose SL.

The bearing 62 is, for example, a pivot bearing, by means of which the closure element 60 is mounted pivotally about a pivot axis SC. The pivot axis SC is, for example, orthogonal to the top surface of the upper side 45A of the cover 44 or to the top surface of the suction device housing 20.

The bearing 62 includes a bearing projection 63 on the closure element 60 which engages in a bearing receptacle 64 on the upper side 15 of the cover 44. The bearing receptacle 64 is designed, for example, as a passage opening on the cover body or the covering wall 46. The bearing projection 63 penetrates the passage opening. From the bearing projection 63, in particular on its free end region, there is a gripping contour 63A, for example a flange-like latching projection or the like, which grips the cover body or the covering wall 46 on an underside of the cover 45 facing away from the upper side 15, so that the closure element 60 is captive, however is pivotally supported on the cover 45 or the suction device housing 20.

The locking body 61 and the bearing projection 63 are arranged on an arm body 65 of the locking element 60. The arm body 65 extends along a longitudinal axis L60 between the bearing projection 63 and the closure body 61, which are arranged at mutually opposite longitudinal end regions of the arm body 65.

The arm body 65 is preferably plate-like and/or is designed in the manner of a strap.

The cover 45 and thus the suction device housing 20 have a closure element receptacle 67 for the closure element 60. The closure element receptacle 67 is designed as a depression on the upper side 45A of the cover 45. An upper side 66 of the closure element 60 facing away from the upper side 45A of the cover 45 does not protrude in front of the upper side 45A of the cover 45 or does not stay behind this upper side 45A, which case is not shown in the exemplary embodiment, but is an option. Thus, the upper side 45A of the cover 45 is available for stacking another container or suction device housing 20 or also of the container attachment 200, which will be explained below, without the closure element 60 representing an interfering contour.

The closure element receptacle 67 is approximately triangular in plan view, for example, with the bearing 62 being arranged in one corner area of this triangle and the suction inlet 12 and a supply receptacle 68 being arranged in the other corner areas.

The supply receptacle 68 is also designed as a plug-in receptacle and has a peripheral wall 69 and a base 70.

The suction inlet 12 is designed as a plug-in receptacle with a peripheral wall 71 into which either the form-fitting body 61 or the suction hose SL can be inserted.

The locking body 61 protrudes in front of the arm body 65 in the manner of a latching projection and has a peripheral wall 72 and a bottom 73. A handle portion 74 protrudes from the bottom 70 into an interior space delimited by the peripheral wall 72 and forms a handle 74A for grasping the closure element 60.

The closure body 61, preferably the closure element 60 as a whole, consists of a flexible material which, on the one hand, enables a press fit or tight fit in the suction inlet 12 or the supply receptacle 68, but on the other hand also enables easy handling. This is explained below:

For example, the arm body 65 is flexible so that the closure body 61 can be moved out of the suction inlet 12 or the supply receptacle 68 while bending the arm body 65.

Alternatively or additionally, a correspondingly movable mounting or pivotable mounting on bearing 62 would also be possible in order to pivot the closure element 60 not only back and forth about pivot axis SC between supply receptacle 68 and suction inlet 12, but also to pivot the same in engagement or disengagement transversely to pivot axis SC with the supply receptacle 68 and the suction inlet 12. For example, the closure element 60 can be movably mounted in the bearing receptacle 65 about a pivot axis SQ running transversely to the pivot axis SC, so that the closure element 60 can be moved away from the upper side 45A and disengaged from the suction inlet 12 or the supply receptacle 68. For this purpose, for example, the bearing projection 63 can have a significantly smaller diameter than the bearing receptacle 64 and thus have a play transversely to the pivot axis SC in the bearing receptacle 64.

The handle portion 74 includes a base wall 75 from which side walls 76 project. The base wall 75 and side walls 76 form an approximately U-shaped or V-shaped configuration in cross section. The side walls 76 extend between the base wall 75 and the bottom 73 of the closure body 61. The base wall 75 and the bottom 70 are, for example, parallel to one another. The side walls 76 face the peripheral wall 72 of the closure body 61. The side walls 76 are advantageously long enough for the handle portion 74 to extend as far as the arm body 65. For example, the base wall 75 is approximately flush with the arm body 65 and/or with the upper side 45A of the cover 45. This makes it easier to grasp the handle 74A.

On the outer periphery of the peripheral wall 72 of the closure body 61 there is a seal 77, for example in the form of ribs or sealing projections 77A, which rests against the peripheral wall 71 or the peripheral wall 72 in a sealing fit or press fit when the closure body 61 engages in the supply receptacle 68 or the suction inlet 12. Thus, in any case, the closure body 61 is held reliably in the supply receptacle 68 or the suction inlet 12. In particular, the seal 77 seals off the suction inlet 12 when no suction hose SL is inserted, so that no dust or other dirt from the dust collection container 36 or the dust collecting chamber 21 can get into the environment. Nevertheless, the operator easily manages to move the closure element 60 from the supply receptacle 68 into the suction inlet 12 or vice versa.

Insertion into the supply receptacle 68 or the suction inlet 12 is possible, for example, by pressing DV on the base wall 75 of the handle section 74.

However, actuation from the suction inlet 12 or the supply receptacle 68 is also easy to effect despite the press fit of the seal 77 on the peripheral wall 71 or 72. The handle portion 74 can namely be gripped with a clamp-like gripping movement and pulled out of the suction inlet 12 or the supply receptacle 68 counter to the direction of the pressure actuation DV.

For example, the side walls 76 are parallel to one another or, as in the exemplary embodiment, are inclined at a small angle to one another, so that when an operator grips the handle portion 74, he can grip the two side walls 76 in a clamp-like manner and move them towards one another, for example by means of a compression load DO. As a result, portions of the peripheral wall 72 and thus the seal 77 are moved away from the peripheral wall 71 or 72 so that the clamping fit of the closure body 61 on the supply receptacle 68 or the suction inlet 12 is removed or at least become less tight. In addition, it can be advantageous if the side walls 76 yield under pressure when the operator acts on them and form recessed grips, so that handling is made even easier. At this point it should be mentioned that rib structures or similar other gripping structures can of course also be provided on the handle section or handle of a closure element in order to facilitate handling.

The suction device 10 advantageously has a container attachment 200 or is compatible with a container attachment 200. The container attachment 200 preferably has the same contour on its outer circumference as the suction device housing 20. The container attachment 200 can be stacked on the suction device 10, namely its suction device housing 20, and connected to it by using the coupling means 58 already explained.

For example, the container attachment 200 comprises a suction device housing 220 with a bottom wall 225 from which longitudinal side walls 226, 227, 228 and 229 protrude, which altogether delimit a receiving space 223 of the container attachment 200. The receiving space 223 is suitable for receiving the suction hose SL.

A handle 224 receiving space 223 protrudes from the bottom wall 225. The handle 224 is designed like a strap, so that the container attachment 200 attached to the suction device housing 20 serves as a carrying handle for carrying a stack 9 consisting of the suction device 10 and container attachment 200. This forms a suction device housing 20 stack housing 20A. The container attachment 200 forms a stacking container 200A.

At the same time, the suction hose SL can be wrapped around the handle 224 so that it serves as a wrapping aid.

A passage 222 for the suction hose SL is provided on the bottom wall 225 and is aligned with the suction inlet 12 when the container attachment 200 is attached to the suction device 10. Furthermore, a lateral opening 221 for the suction hose SL is provided on the longitudinal side wall 28.

On the longitudinal side wall 226, locking elements 251, 259 are provided as coupling means 58, which are structurally identical to and/or compatible with the locking elements 51 and 59. Thus, for example, the locking element 51 of the suction device 10 can be brought into engagement with the locking element 259 in order to form the stack 9 consisting of the suction device 10 and the container attachment 200 stacked on top.

Feet, not visible in the drawing, corresponding to feet 54 and 55, are provided on the side of the bottom wall 225 facing away from the receiving space 223, which feet can be brought into engagement with the receptacles 56 and 57 of the suction device housing 20, so that in combination with the interlocking locking elements 51 and 259 of the coupling means 58, a secure hold of the container attachment 200 on the suction device 10 can be effected in the direction of the stacking axis SR or in the stacking direction.

However, the coupling means 58 also readily bring about a fixed connection between the container attachment 200 and the suction device housing 20 transversely to the stacking axis SR.

Figure 6:
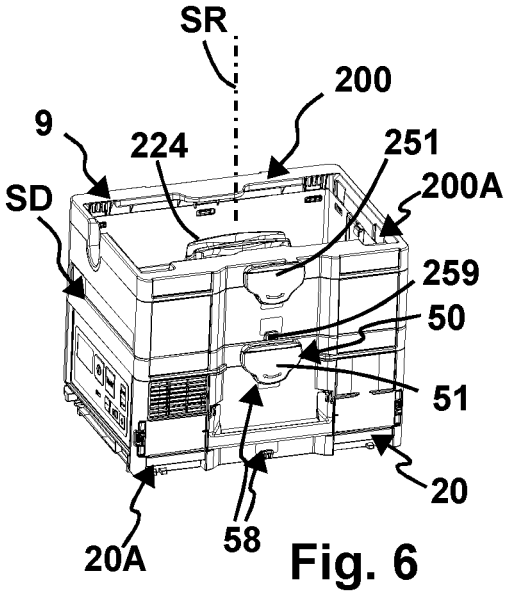
FIG. 6 shows the suction device according to the previous figures with a container attachment in an oblique frontal perspective.
Figure 7:
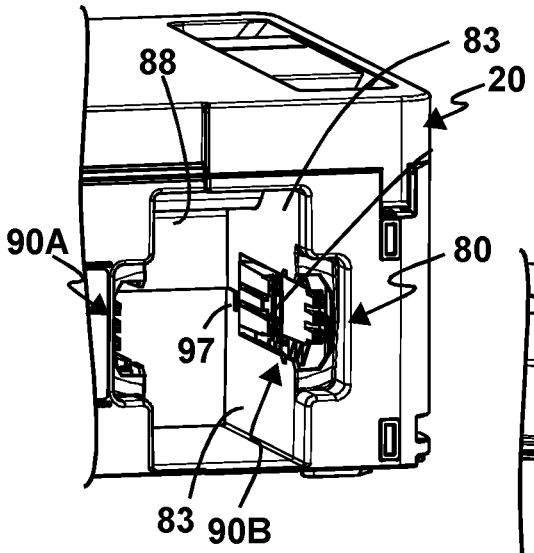
FIG. 7 shows a perspective partial rear view of the suction device according to FIG. 3, with the energy storages removed, roughly corresponding to a section D2 in FIG. 3.
Figure 8:
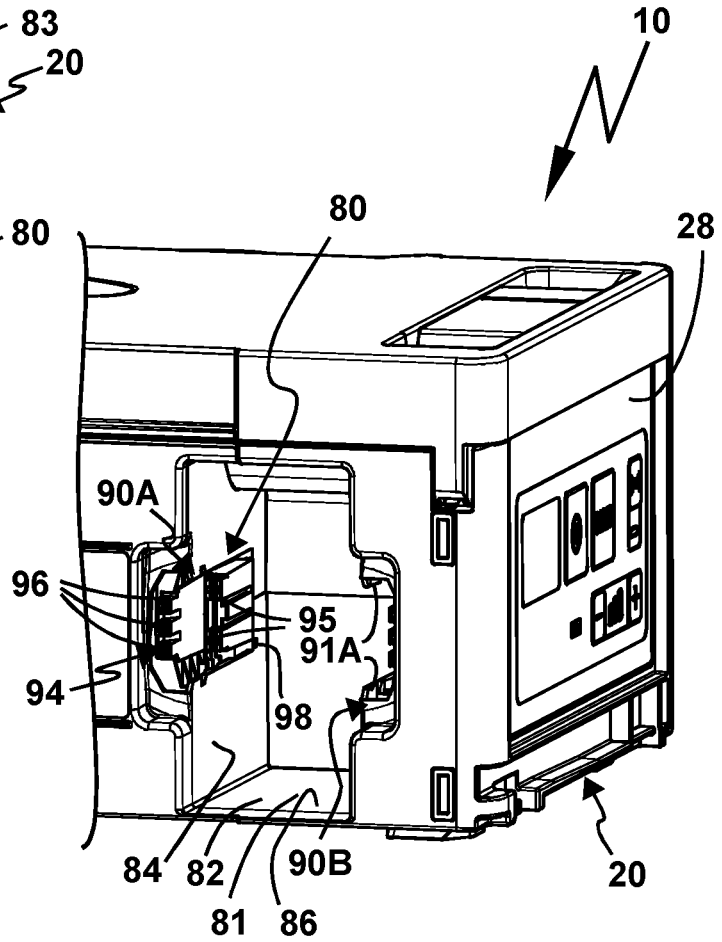
FIG. 8 shows the part of the suction device shown in FIG. 7, but with a different oblique perspective.
Figure 9:
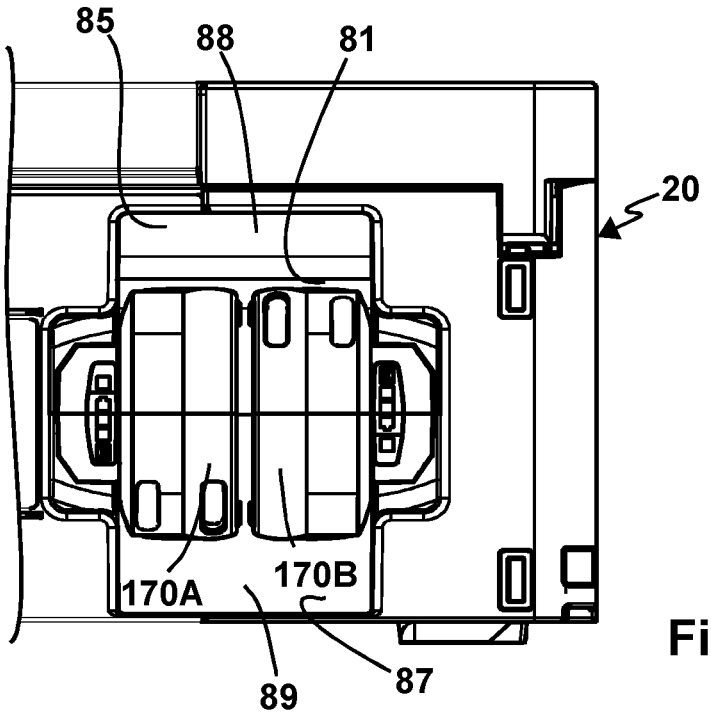
FIG. 9 shows the part of the suction device shown in FIGS. 7 and 8 in a front view with energy storages.
Figure 10:
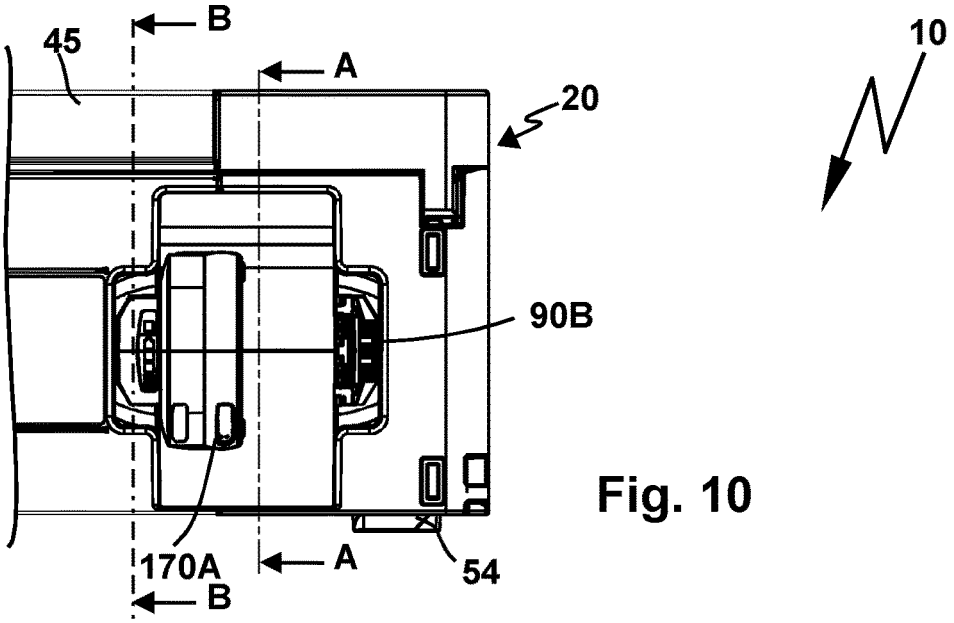
FIG. 10 shows the view corresponding to FIG. 9, but with only one energy storage.
Figure 11:
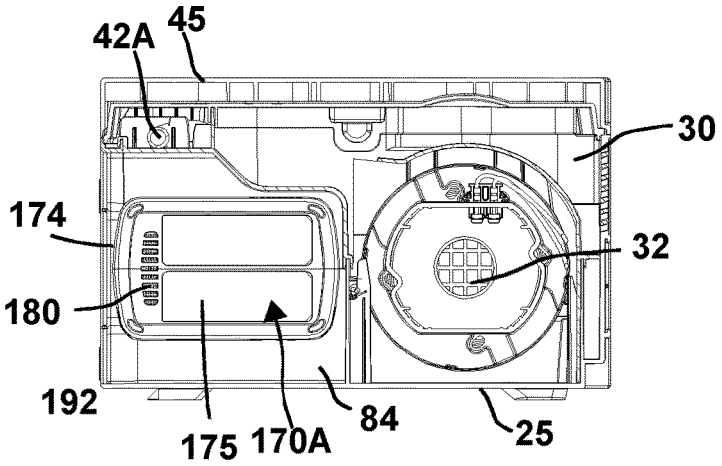
FIG. 11 shows a section through the suction device according to FIG. 10, approximately along a section line A-A in FIG. 10.
Figure 12:
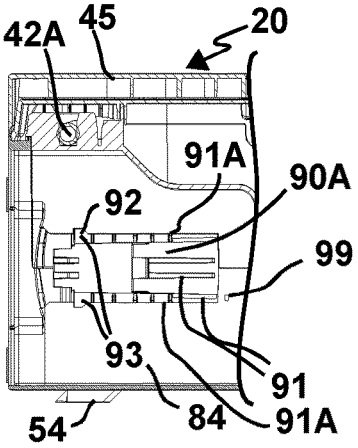
FIG. 12 shows a section through the suction device according to FIG. 10, approximately along a section line B-B in FIG. 10.
Figure 13:
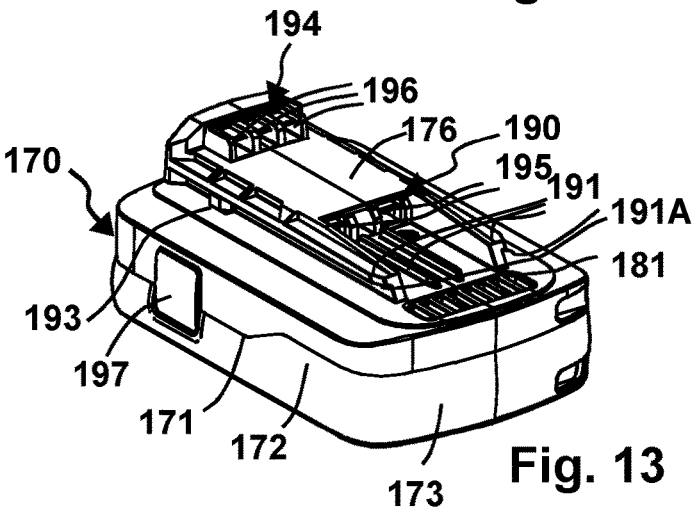
FIG. 13 shows a perspective oblique view of an energy storage of the suction device.
Figure 14:
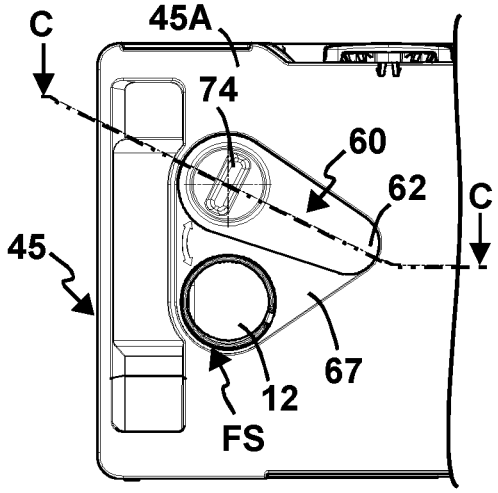
FIG. 14 shows a front view of the suction device from above, roughly corresponding to section D1 in FIG. 1, with the suction inlet being open as in FIG. 1.
Figure 15:
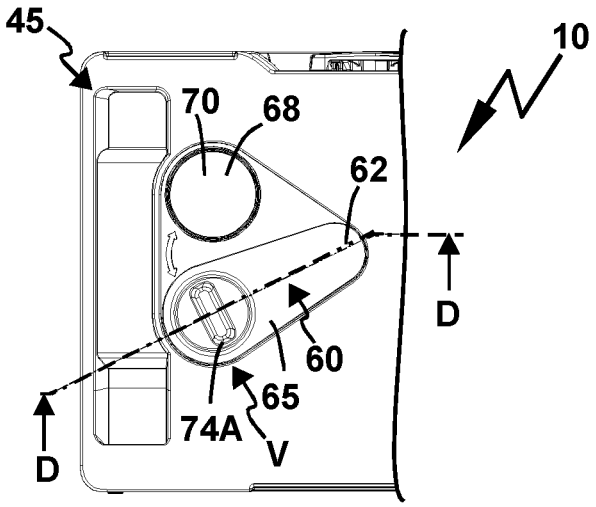
FIG. 15 shows the view corresponding to FIG. 14, with the suction inlet being closed by the closure element.
Figure 16:
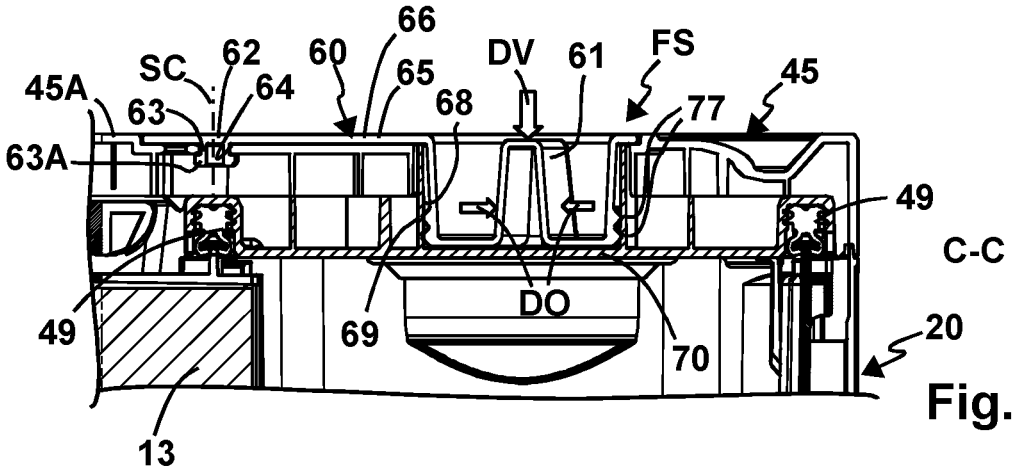
FIG. 16 shows a cross-sectional view through the arrangement according to FIG. 14, approximately along section line C-C in FIG. 14.
Figure 17:
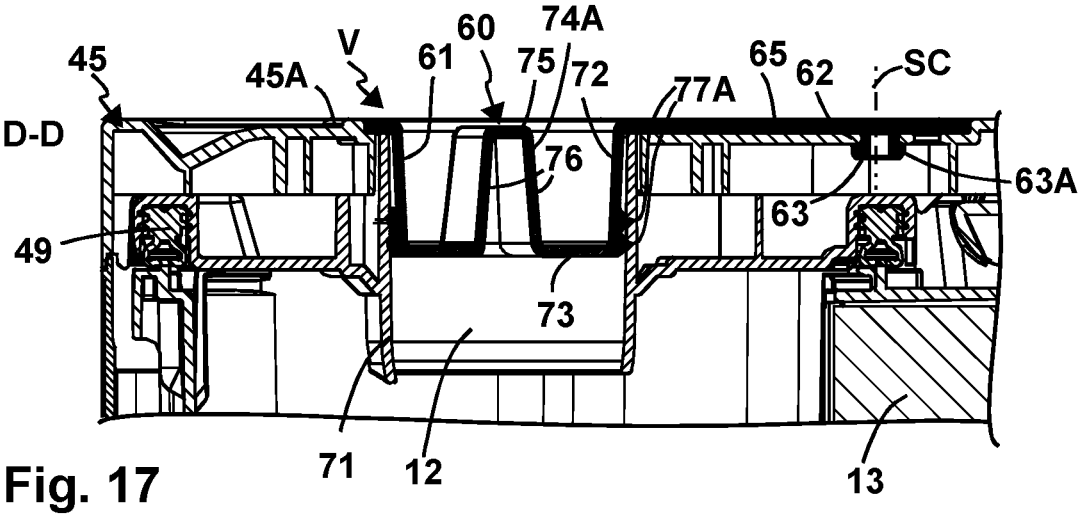
FIG. 17 shows a cross-sectional view through the arrangement according to FIG. 15, approximately along section line D-D in FIG. 15.
Figure 18:
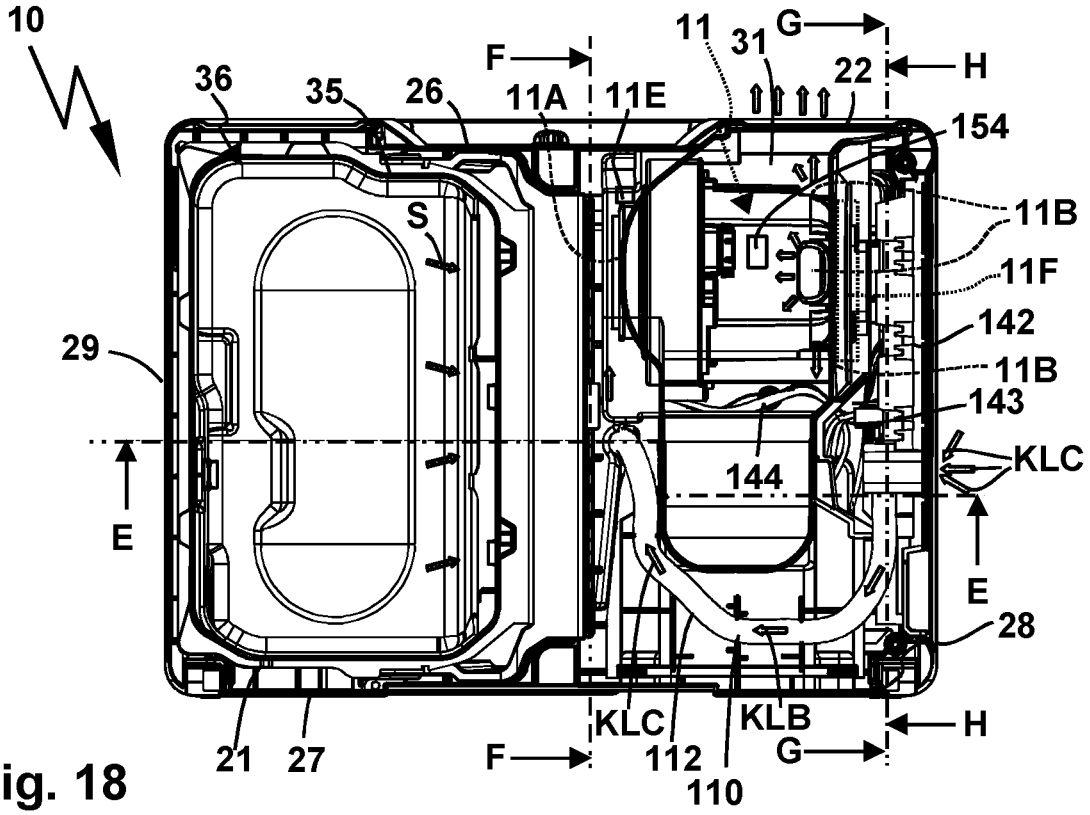
FIG. 18 shows a front view from above of an open lower part of the suction device according to the preceding figures.
Figure 19:
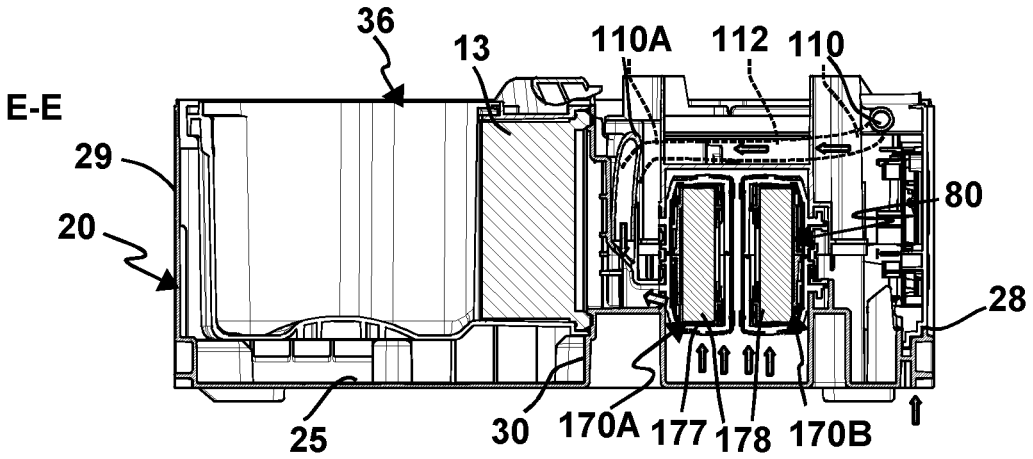
FIG. 19 shows a section approximately along a section line E-E through the lower part of the suction device according to FIG. 18.
Figure 20:
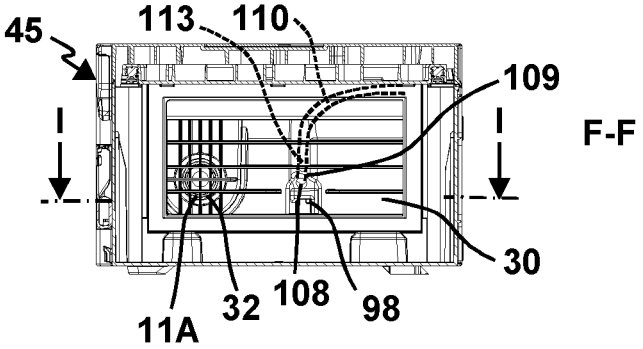
FIG. 20 shows a section through the suction device, approximately along a section line F-F in FIG. 18.
Figure 23:
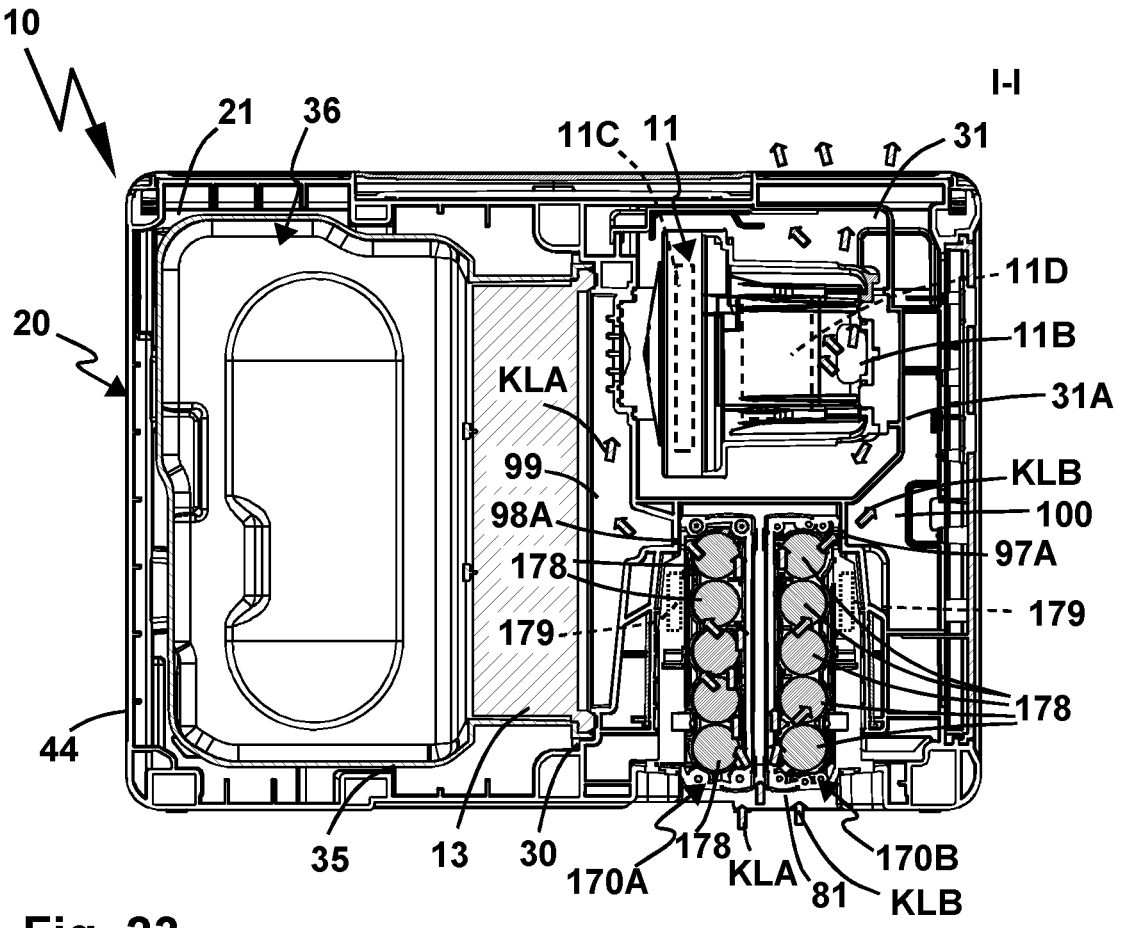
FIG. 23 shows a section through the part of the suction device according to FIGS. 18 to 22, approximately along a section line I-I in FIG. 20.
Figure 21:
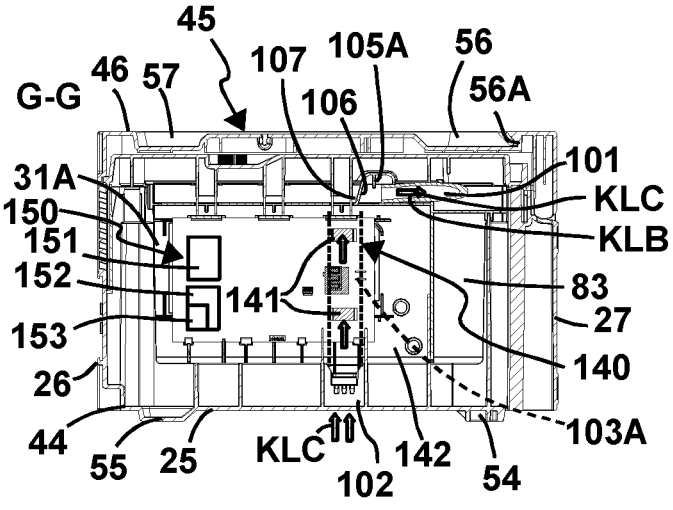
FIG. 21 shows a section through the suction device, approximately along a section line G-G in FIG. 18.
Figure 22:
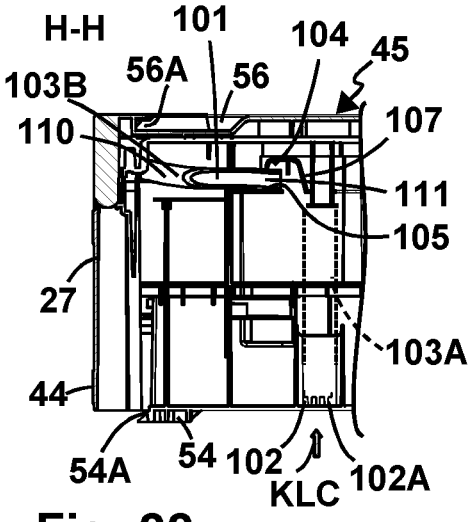
FIG. 22 shows a section through the suction device, approximately along a section line H-H in FIG. 18.
Figure 24:
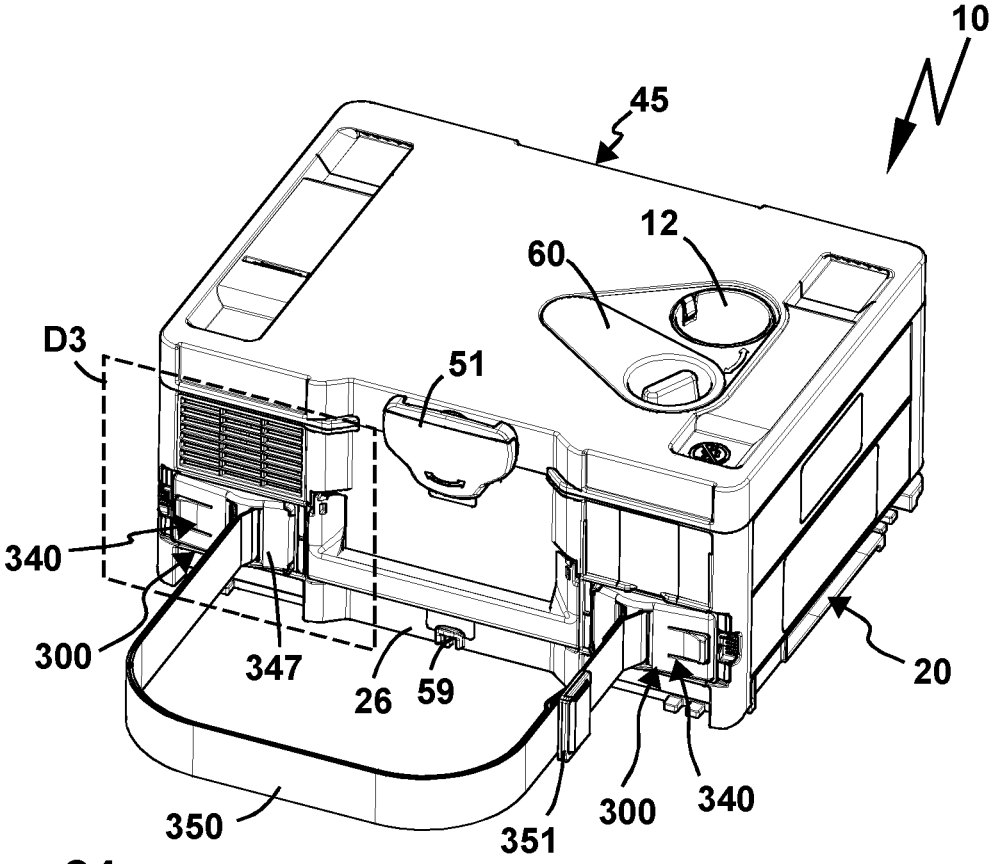
FIG. 24 shows the suction device according to the preceding figures with a carrying strap.
Figure 25:
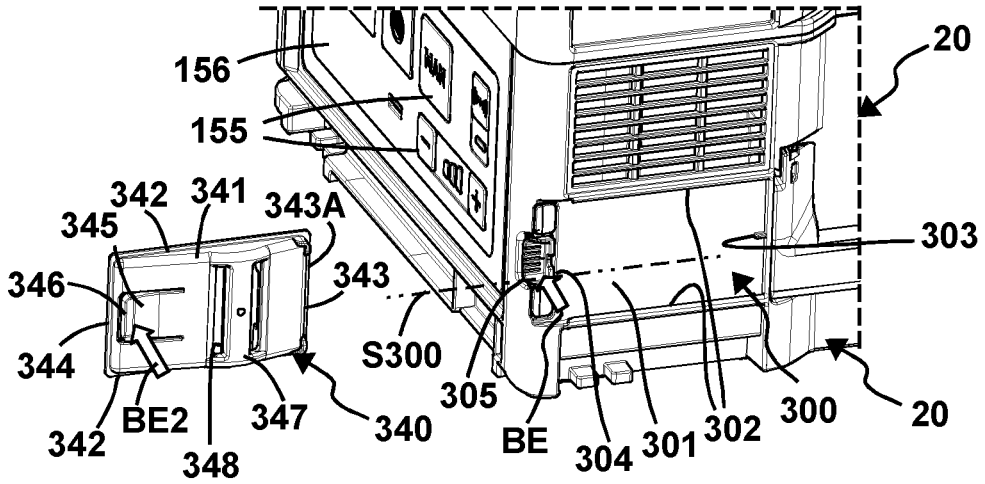
FIG. 25 shows a detail D3 from FIG. 24, but with the carrying strap removed and a fastening device for the carrying strap.
Figure 26:
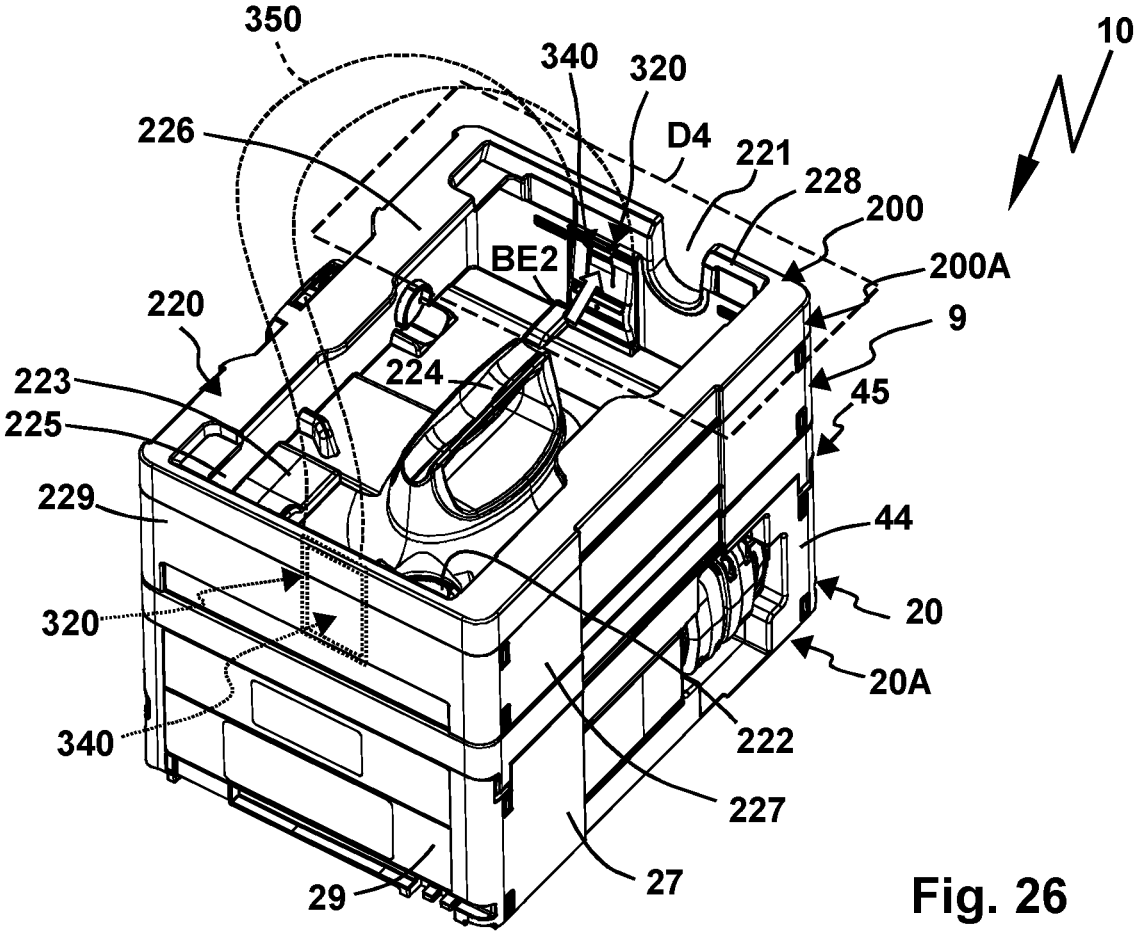
FIG. 26 shows the suction device according to the previous figures with a container attachment in a perspective oblique view, with the carrying strap shown schematically being attached to the container attachment.
Figure 27:
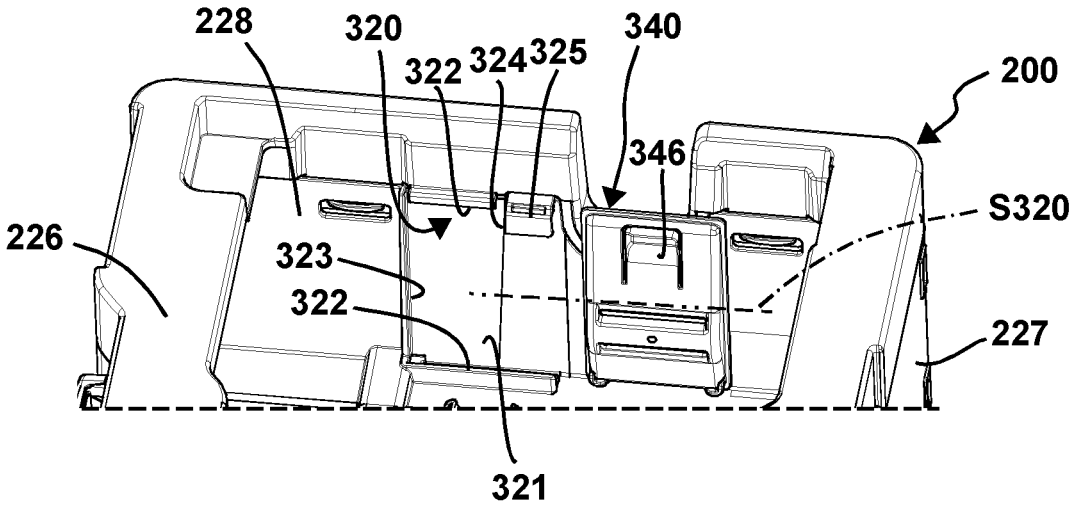
FIG. 27 shows a detail D4 from FIG. 26, the fastening device of the carrying strap being shown in a release position.

Further containers, for example containers for transporting tools, can be stacked over or stacked underneath of the stack 9, which can be coupled to the container attachment 200 or the suction device housing 20 using coupling means that are compatible with the coupling means 58. For example, the container attachment 200 can also be arranged under the suction device housing 20 and connected to it by means of the coupling means 58 to form a stack. Furthermore, another container attachment 200, not shown in the drawing, or another suction device 10, not shown, can be stacked, for example, on the upper container attachment 200 in FIG. 6 and can be coupled to it to form a stack using coupling means that are compatible with coupling means 58.

In principle, it would now be possible to design the suction device 10 as a suction device that can be operated via a power supply outlet. However, the suction device 10 is not only extremely compact, but can also be used flexibly, in that the suction device 10 has a power supply device 80 to which energy storages 170, for example so-called battery packs, can be connected.

Two energy storages 170 of the same type, also referred to below as energy storages 170A, 170B, are provided for the power supply.

The power supply device 80 comprises an energy storage receptacle 81 in the region of the suction turbine part 24. The energy storage receptacle 81 extends between the longitudinal side wall 28 and the intermediate wall 30 over almost the entire distance between the longitudinal side wall 28 and the intermediate wall 30, so that in the energy storage receptacle 81 two energy storages 170 can be arranged.

The energy storage receptacle 81 includes an insertion opening 82 through which the energy storages 170 can be inserted into the energy storage receptacle 81. The insertion opening 82 is delimited by side walls 83, 84, which run next to the side wall 28 of the suction device housing 20 and the intermediate wall 30 of the suction device housing 20, in particular parallel to the same. Extending between the side walls 83 and 84 there is a side wall or connecting wall 85 closer to the cover 45 and a side wall or thick wall 86 closer to the bottom wall 25 or formed by the bottom wall 25. The energy storage receptacle 81 is delimited by a bottom wall 87 which is opposite the insertion opening 82.

Device interfaces 90A, 90B, hereinafter also uniformly referred to as interfaces 90, are arranged on the side walls 83, 84, with which the energy storages 170 can be connected, which have energy storage interfaces 190 that match the interfaces 90.

For example, the interfaces 90, 190 include complementary longitudinal guide contours 91, 191, which can be inserted into one another along a plug-in axis SA. For example, the longitudinal guide contours 91, 191 include longitudinal grooves and longitudinal projections that can engage in one another.

Rear-gripping contours 91A, 191A of the interfaces 90, 191 extend transversely to the respective plug-in axis SA, with which the energy storages 170 can be brought into form-fitting engagement with the device interfaces 90 transversely to the respective plug-in axis SA.

The interfaces 90, 190 can be connected to one another in a form-fitting manner on the basis of the rear-gripping contours 91A, 191A and the longitudinal guide contours 91, 191, apart from a sliding mobility along the respective plug-in axis SA.

Furthermore, the interfaces 90, 190 include latching devices 92, 192 in order to latch the energy storages 170 to the device interfaces 90. The latching devices 92 are designed, for example, as latching receptacles 93 into which the latching projections 193 of the latching devices 192 can engage in a latching manner, so that the energy storages 170 are held in a non-displaceable manner at the interfaces 90 with respect to the plug-in axis SA. The latching projections 193 are, for example, spring-loaded or resilient in the direction of their locking position in which they engage in the latching receptacles 93 and can be disengaged from the latching receptacles 93 against the aforementioned spring loading.

The interfaces 90, 190 include contact arrangements 94, 194 to establish electrical connections between the energy storage 170 and the suction device 10. The contact arrangements 94, 194 include, for example, energy supply contacts 95, 195 with different polarity, for example a positive potential and ground, as well as data contacts 96, 196 for data transmission between the suction device 10 and the respective energy storage 170. Such a data transmission provides, for example, a digital bus data transmission, in particular with an I2C bus.

The energy storages 170 are advantageously structurally identical. Each energy storage device 171 has an energy storage device housing 171, which comprises longitudinal side walls 172 on its longitudinal sides 172A and end-side walls 173, 174 extending between these. Extending between the side walls 172-174 is a bottom wall 175 and, opposite this, an interface wall 176 on which the energy storage interface 190 is arranged. The interface wall 176 can have a stepped shape, such that the data contacts 196 are at a greater distance from the bottom wall 175 than the power supply contacts 195.

Furthermore, the power supply contacts 195 and the data contacts 196 are arranged one behind the other in relation to the plug-in axis SA. For example, the data contacts 196 are arranged at the front along the plug-in axis SA in the plug-in direction, namely closer to the end wall 173, while the supply contacts 195 are arranged to the rear in the plug-in direction along the plug-in axis SA, namely near the end side wall 174. The energy storage housing 171 has an interior 177 in which battery cells 178 are arranged, protected from environmental influences. However, the battery cells 178 heat up, for example, when charging or discharging, namely when the suction device 10 is operated using the energy storage 170. However, the battery cells 178 in the energy storages 170 are actively cooled, for which purpose each energy storage 170 has a fan 179. The fan 179 generates a cooling air flow KL, which flows through an energy storage inflow opening 180 into the interior space 177 and through an energy storage outflow opening 181 out of the latter. For example, the energy storage inflow opening 180 is arranged on the bottom wall 175 while the energy storage outflow opening 181 is arranged on the interface wall 176. In addition, the energy storage inflow openings 180 and the energy storage outflow openings 181 are arranged on opposite longitudinal end regions of the energy storage 170, namely close to the end wall 174 and the end wall 173, so that the cooling air flow KL, for example a cooling air flow KLA in the case of the energy storage 170 and a cooling air flow KLB in the case of the energy storage 170B, flows through a respective energy storage device 170, so to speak, from the back to the front with respect to the plug-in direction or plug-in axis SA.

The device interfaces 90 are arranged on opposite sides of the energy storage receptacle 81, namely on the side walls 83 and 84. Accordingly, the energy storages 170 are received in the energy storage receptacle 81 with bottom walls 175 lying opposite one another.

Operating elements 197 are provided on the longitudinal side walls 172 of the energy storage housing 171 in order to actuate the latching devices 192. An operator can therefore grip the energy storage housing 171 laterally and/or in a clamping manner, so to speak, in order to act simultaneously on the two operating elements 197 arranged on the opposite longitudinal side walls 172, in order to disengage the latching projections 193 from the latching receptacles 93, so that the respective energy storage device 170 is removable from the device interface 90.

The receptacles 81 allow convenient handling, because between the connecting walls 85, 86 and the energy storage devices 170 inserted into the energy storage receptacle 81, there are operating spaces 88 and 89, into which an operator can grasp the operating elements 197, which, for example, have pressure surfaces or have touch surfaces. The control spaces 88 and 89 are, so to speak, uniform or continuous control spaces, because there is no separating component between the energy storages 170 received in the energy storage receptacle 81. If, for example, the energy storages 170 were received in the energy storage receptacle 81 with the energy storage interfaces 190 facing one another, there would have to be an intermediate wall in the energy storage receptacle 81 on which the device interfaces 90 are arranged.

In addition, due to the generous design of the control spaces 88 and 89, the operator can grasp the energy storages 170, for example on their longitudinal side walls 172, in order to remove them from the energy storage receptacle 81. However, this also makes operation easier when inserting the energy storage device 170 into the energy storage device receptacle 81, because in this case too the operator can grasp the longitudinal side walls 172 in order to plug a respective energy storage device 170 into the device interface 90 assigned to it.

The side walls 83, 84 are advantageously spaced apart from one another in such a way that the energy storages 170 connected to the device interfaces 90 have a spacing between their bottom walls 175, so that the cooling air flow KL can flow into the space between the bottom walls 175.

Outflow openings 97 and 98, which are close to the device interfaces 90 and thus arranged close to the energy storage outflow openings 181 of the energy storage 170 on the side walls 83 and 84 of the energy storage receptacle 81 are used for discharging cooling air flows KL of the energy storages 170, which are arranged on the device interfaces 90. The outflow openings 97 and 98 are hereinafter referred to as receptacle outflow openings because of their location in the energy storage receptacle 81 and are located close to the bottom wall 87 such that little or no heat builds up in the energy storage receptacle 81.

The receiving outflow opening 98 opens directly into an intermediate space between the intermediate wall 30 and the filter element 13, so that a cooling air duct 99 is formed between the intermediate wall 30 and the filter element 13, which leads from the receiving outflow opening 98 to the through-flow opening 32 on the intermediate wall 30. Thus, a cooling air flow KLA of the energy storage 170 arranged on the side wall 84 can flow out of the receiving outflow opening 98 and is sucked off by the suction turbine 11 via the cooling air duct 99. In this case, the suction turbine 11 can even intensify the cooling air flow KLA, which is indicated schematically by arrows.

The energy storage 170B can be cooled by a cooling air flow KLB, which can flow out of the energy storage receptacle 81 through the outflow opening 97. The receiving outflow opening 97 forms a duct inflow opening 97A for a cooling air duct 100.

It is easily possible, for example by means of a hose connection line or the like, to fluidically connect the intake outflow opening 97 to the through-flow opening 32 on the intermediate wall 30 or at least to a suction turbine inflow opening 11A of the suction turbine 11, so that the cooling air flow KLB flows directly to the suction turbine 11 or is sucked in by it.

In the present case, however, a different construction has been selected, in which the cooling air duct 100 does not lead directly to the through-flow opening 32, but rather opens into another cooling air duct 101, which is used to cool other components of the suction device 10, for example to cool an energization device 140 and also for a permanent cooling of the suction turbine 11.

The suction turbine 11 is, for example, a so-called through-flow turbine or a turbine which is or can be cooled by the suction flow conveyed by it.

Such permanent cooling of the suction turbine 11 is particularly important when it cannot otherwise suck in sufficient air on the inflow side. Such a situation occurs, for example, when the suction inlet 12 is clogged or blocked, when the filter element 13 is no longer clear, when the dust collecting chamber 21 is overfilled, or the like.

The suction turbine 11 is a so-called flow-through turbine. The suction turbine 11 has the suction turbine inflow opening 11A on its side facing the flow opening 32 and at least one, preferably several suction turbine outflow openings 11B on its side facing away from the flow opening 32.

It is advantageous if a seal 11E is provided between the intermediate wall 30 on the one hand and the end face of the suction turbine 11 which faces the intermediate wall 30 and has the suction turbine inflow opening 11A on the other hand, so that it bears tightly against the intermediate wall 30 and the suction flow S can flow through the through-flow opening 32, but not in the suction turbine receiving space 31 in which the suction turbine 11 is arranged.

The suction turbine receiving space 31 is delimited by a side wall 31A in the region of the suction turbine outflow openings 11B. Between the side wall 31A and the end face of the suction turbine 11, on or next to which the suction turbine outflow openings 11B are arranged, a suction turbine bearing element 11F is advantageously arranged, which is elastically flexible, so that this suction turbine bearing element 11F and the seal 11E hold the suction turbine 11 in the suction device housing 20 in a vibration-damped manner.

The suction turbine 11 has a fan 11C, shown schematically, and an electric drive motor 11D for driving the fan 11C. The drive motor 11D is cooled by the suction flow S during normal operation of the suction device 10, namely when the suction flow S is flowing.

The suction device 10 has an energization device 140 for energizing the suction turbine 11, in particular the drive motor 11D. The energization device 140 includes, for example, one or more power electronic semiconductor elements 141, for example thyristors, MosFets or the like. The semiconductor elements 141 heat up during operation, namely when the suction turbine 11 is supplied with current.

The energization device 140 is arranged on a printed circuit board 104 which is arranged in a sandwich-like manner between the longitudinal side wall 28 and the side wall 83 of the energy storage receptacle 81 of the power supply device 80. The printed circuit board 104 also partially extends into an intermediate space between the side wall 28 of the side wall 31A. The energization device 140 is connected to the device interfaces 90A, 90B, in particular the energy supply contacts 95, by means of lines 143. Lines 144 connect the energization device 140 to the suction turbine 11.

Furthermore, the suction device 10 advantageously has a controller 150. The controller 150 includes, for example, a processor 151 and memory 152, in which at least one control program 153 for controlling the suction turbine 11, for example, is provided.

An operator can control the suction device 10 using operating elements 155 which are arranged on a control panel 156. The control panel 156 is arranged on the side wall 28.

The controller 150 is electrically connected to the operating elements 155. With the operating elements 155, the suction device 10 can be switched on or off, for example. Furthermore, the power of the suction turbine 11 can be adjustable using the operating elements 155. A display 157 is advantageously provided on the control panel 156, for example to display a status of the suction device 11.

The controller 150 also generates heat, the dissipation of which is advantageously accomplished in the suction device 11, as will become clear below.

The cooling air duct 101 is fluidically connected to the receiving outflow opening 97. Air can thus flow into the cooling air duct 101 via the receiving outflow opening 97, for example the cooling air flow KLB. However, the cooling air flow KLB has already been heated due to the cooling of the energy storage 170B.

Ambient air, that is to say generally cooler air, can flow into the cooling air duct 101 via a duct inflow opening 102 as a cooling air flow KLC. The duct inflow opening 102 is arranged, for example, close to the bottom wall 25 on a region of the longitudinal side wall 28 facing the bottom wall 25. A protective grille 102A is advantageously arranged on the duct inflow opening 102.

The cooling air flow KLC flows via the duct inflow opening 102 into a duct portion 103A of the cooling air duct 101, which runs between the printed circuit board 142 and the side wall 31A. Consequently, the cooling air flow KLC flows behind the printed circuit board 142 or the cooling air flow KLC flows past the printed circuit board 142. In this case, the duct portion 103A is selected such that the cooling air flow KLC essentially flows past the energization device 140, namely in particular past the semiconductor elements 141, which become particularly warm during operation of the suction device 11. However, such heating and, in the worst case, overheating is effectively counteracted using the cooling air flow KLC.

At its end remote from the duct inflow opening 102, the duct portion 103A opens into a hose receptacle 104, in which a hose 110, thus a tubular body 110A for guiding cooling air, is received.

The hose receptacle 104 has, for example, a plug-in receptacle 105 into which the hose 110 is inserted, and an air-guiding surface 106 on a wall 107.

The cooling air flow KLC flowing out of the duct portion 103A is guided into an inlet opening 111 of the hose 110 via the air guiding surface 106. There is a distance between the inlet opening 111 and the air guiding surface 106 or the wall 107 so that the cooling air flow KLC can flow into the inlet opening 111 unhindered.

The design and/or a cross section of the plug-in receptacle 105 ensures that the hose 110 is only compressed to such an extent that it is securely clamped in the plug-in receptacle 105, but is not compressed to such an extent that its flow cross section is no longer sufficient for the cooling air flow KLC to pass through. A plug-in stop 105A is advantageously located opposite the plug-in receptacle 105, against which a jacket of the cooling-air hose 110 can abut when it is inserted into the plug-in receptacle 105. The plug-in stop 105A is at a distance from the air-guiding surface 106. The inlet opening 111 cannot be closed by the air-guiding surface 106 because of the plug-in stop 105A.

The cooling air flow KLB can flow past the circuit board 142 and/or in a gap between the circuit board 142 and the covering wall 34 and also into the inlet opening 111 of the cooling air hose 110, so that the cooling air hose 110 directs both the cooling air flow KLB and the cooling air flow KLC in the direction of the duct outflow opening 108. The cooling air hose 110 thus provides a common duct portion 103B for the cooling air flows KLB and KLC.

The cooling air hose 110 has a hose portion 112, which guides the cooling air flow KLC and/or the cooling air flow KLB past the suction turbine receiving space 31 to a duct outflow opening 108, which is arranged on the intermediate wall 30 and opens out into the space between the intermediate wall 30 and the filter element 13. There, the cooling air flow KLC and/or the cooling air flow KLB can flow in the direction of the through-flow opening 32 in order to be sucked in by the suction turbine 11.

The hose section 112 has an arcuate course. An end region 113 of the tube portion 112 is held in the area of the duct outflow opening 108 in a receptacle 109 which is designed, for example, as a plug-in receptacle.

The cooling air flows KLA, KLB primarily cool the energy storages 170A, 170B, but also the suction turbine 11.

Furthermore, although the cooling air flow KLC cools the power supply device 140, it also cools the suction turbine 11.

Since smaller cooling air flows are required to cool energy storages 170A, 170B, cooling air ducts 99 and 100 advantageously have smaller flow cross sections than cooling air duct 101. The cooling air duct 101 namely cools the power electronics, e.g. the semiconductor elements 141. This measure contributes to the fact that sufficient cooling air flows through the cooling air duct 101 and not, so to speak, past it through the cooling air ducts 99 and/or 100.

The duct inflow openings 97A, 98A and 102 are permanently open. The cooling air flows KLA, KLB and KLC can thus permanently contribute to the cooling of the suction turbine 11.

Furthermore, a sensor 154 is arranged on the suction turbine 11, the sensor signals of which are evaluated by the controller 150. The sensor 154 includes or is, for example, a temperature sensor and/or pressure sensor and/or flow sensor. Due to the permanent cooling of the suction turbine 11 using the cooling air flows KLA, KLB and KLC, even when the suction flow S is interrupted or not flowing, there is sufficient flow pressure at the sensor 154 so that it can report valid temperature signals to the controller 150.

Finally, controller 150 is designed to monitor a volume flow of suction flow S, for example using the at least one control program 153.

Figure 28:
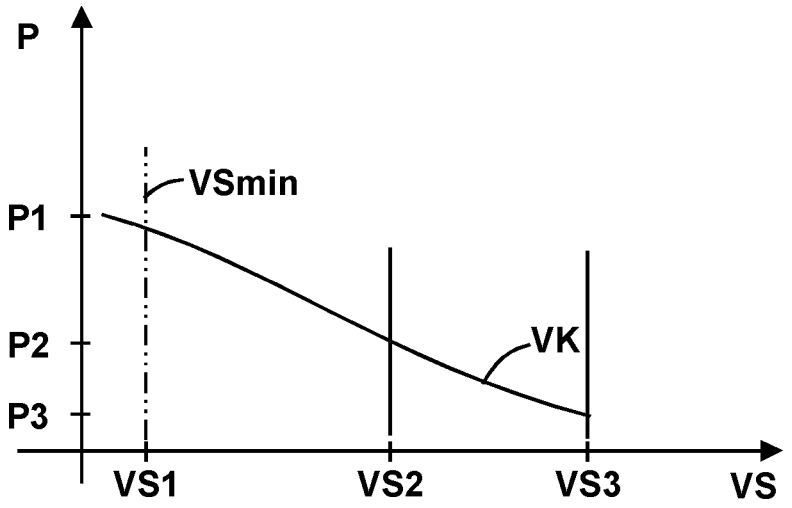
FIG. 28 shows a characteristic curve of a volume flow through the suction turbine of the suction device.
Figure 29:
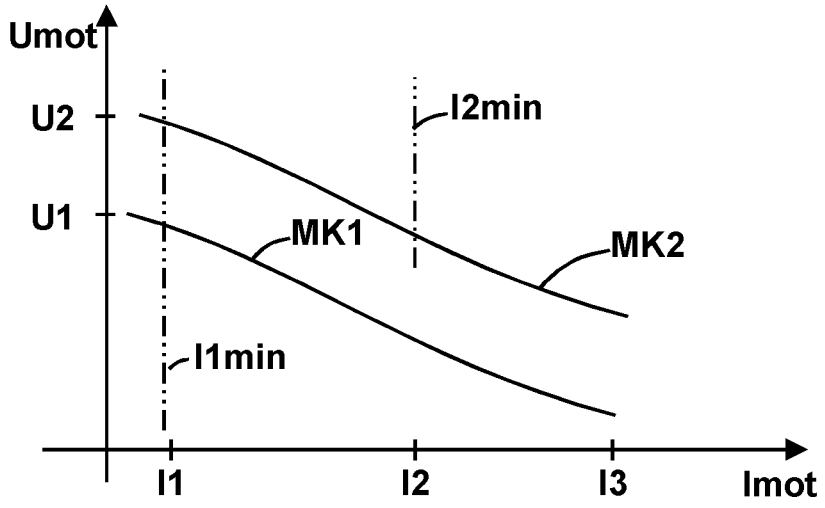
FIG. 29 shows motor characteristics of a drive motor of the suction turbine.

For example, the suction flow S has a volume flow VS, which has a pressure-dependent profile dependent on a pressure P. A characteristic curve VK of a volume flow of the suction flow S is shown schematically in FIG. 28. For example, at pressures P1, P2 and P3 which are negative pressures or underpressures, the volume flow VS has values VS1, VS2 and VS3 in liters per second.

For example, the suction flow S should not fall below a minimum speed of 20 m/s, for example, so that a so-called dust class is fulfilled, according to which the suction device 10 always ensures adequate suction for this dust class.

Depending on the diameter of the suction hose SL, the required minimum speed of the suction flow S results in a minimum value VSmin for the volume flow of the suction flow S, which is approximately 10 l/s for a hose diameter of 27 mm for the suction hose SL.

Due to the constant air flow, which is provided by the cooling air flows KLA, KLB and KLC, among other things, the controller 150 can calculate a characteristic VK of the volume flow of the suction flow S, based on motor characteristics MK1 and MK2 as well as other motor characteristics of the drive motor 11D of the suction turbine 11, not shown in the drawings, because both the characteristic curve VK and the motor characteristics MK1 and MK2 have a substantially constant, in particular substantially linear, profile in the area relevant for monitoring the volume flow or the flow rate of the suction flow S.

The motor characteristics MK1 and MK2 depend on the voltages U1 and U2 with which the drive motor 11D is operated. The motor characteristics MK1 and MK2 are proportional to a current profile of the motor current Imot, with which the drive motor 11D is energized by the energization device 140.

The controller 150, in particular the control program 153, controls the energization device 140 and receives feedback from it, for example, the motor voltage present, for example the motor voltages U1 and U2, and the respective motor current Imot for energizing the drive motor 11D.

If the motor characteristic MK1 or the motor current Imot falls below the value I1*min* or the motor characteristic MK2 or the motor current Imot falls below the value I2*min*, which correspond to the minimum value VSmin for the volume flow of the suction flow S, the controller 150 recognizes that the flow rate of the suction flow S is too low and issues a warning on the display 157, for example. In this case, the controller 150 can alternatively or additionally output an acoustic warning to a loudspeaker or other acoustic output means 158.

A carrying strap 350 is advantageously suitable for conveniently transporting the suction device 10 or the stack 9 consisting of the suction device 10 and container attachment 200 or the container attachment 200 alone. The carrying strap 350 can be ergonomically adapted to the respective carrying situation using a length adjustment device 351.

The carrying strap 350 can be fastened either to the suction device 10 or to the container attachment 200. For this purpose, the carrying strap 350 has a fastening device 340 on each of its longitudinal end regions.

The attachment devices 340 can be brought into engagement with attachment receptacles 300 of the suction device 10 or with attachment receptacles 320 of the container attachment 200 as required.

The fastening devices 340 have base bodies 341 which are designed like plates.

The base bodies 341 have rear gripping contours 342 on their longitudinal sides, which, in cooperation with rear gripping contours 302 of the fastening receptacle 300, serve as longitudinal guides along which the fastening devices 340 can be inserted into a respective fastening receptacle 300 along a plug-in axis S300.

In the plug-in direction at the front with respect to a plug-in axis S300, the base body 341 has another rear gripping contour 343, the front portion 343A of which abuts against a stop 303 of the fastening receptacle 300 at the end of the plug-in movement along the plug-in axis S300.

Then a bolt 304 of the fastening receptacle 300, which can be actuated using an actuating surface or actuating contour 305, can reach its locking position, in which it reaches behind and/or over a rear-gripping contour 344 of the fastening device 340.

The bolt 304 is spring-loaded into its locking position, for example, and can be actuated against this spring loading by means of an actuating surface 305 with an unlocking actuation BE in the direction of its release position. The bolt 304 then disengages from the rear gripping contour 344 so that the fastening device 300 can be moved out of the fastening receptacle 300 designed as a plug-in receptacle.

The rear gripping contour 343 and the rear gripping contour 344 extend between the rear gripping contours 342. The rear gripping contour 343 and the rear gripping contour 344 are arranged on opposite longitudinal end regions of the base body 341.

The fastening receptacles 320 are also designed as plug-in receptacles. A fastening device 340 can be inserted into a respective fastening receptacle 320 along a plug-in axis S320 or can be moved out of the fastening receptacle 320 along the plug-in axis S320.

With regard to the fastening receptacle 320, the rear gripping contours 343 and 344 of the fastening device 340 act as longitudinal guide contours which can engage with longitudinal guide contours or rear gripping contours 322 of the fastening receptacle 320 and guide the fastening device 340 along the plug-in axis S320.

One of the rear gripping contours 342 of the fastening device 340, which is at the front in the insertion direction with respect to the plug-in axis S320, abuts against a stop 323 on the bottom or end of the fastening receptacle 320 with respect to the plug-in axis S320. A gripping contour for receiving this gripping contour 342 can optionally be provided there. A bolt 346 of the fastening device 340 can then also engage with a locking contour 324 of a locking element 325 of the fastening receptacle 320, so that the fastening device 340 is locked in the fastening receptacle 320.

The bolt 346 is designed as a resilient tongue or resilient element with respect to the base body 341 and has an actuating surface 345 with which it can be disengaged from the locking contour 324 of the fastening receptacle 320, which is indicated by an arrow or an actuation BE2 in the drawing.

The fastening devices 340 have strap receptacles 347 for the carrying strap 350. The carrying strap 350 can, for example, be pushed through a push-through opening 348 of a strap receptacle 347 and be held in a frictionally engaged manner on the strap receptacle 347 by means of appropriate sling measures.

The fastening receptacles 320 of the container attachment 200 are located on the longitudinal side walls 228 and 229 in such a way that the carrying strap 340 can be brought into engagement with the attachment receptacles 320 bridging the receiving space 223 of the container attachment 200. Thus, the stack 9 can, so to speak, hang down from the carrying strap 350 and be carried comfortably.

The mounting receptacles 300, on the other hand, allow the suction device 10 to be carried in the manner of a shoulder bag. For example, the fastening receptacles 300 are arranged on one of the longitudinal side walls 26, 27, 28 or 29, specifically on the longitudinal side wall 26 in the exemplary embodiment. In any case, it is advantageous if the fastening receptacles 300 are arranged on the narrow sides of the suction device housing 20.

It is advantageous if the fastening receptacle 300 is arranged in longitudinal end regions of the longitudinal side wall 26, namely close to the longitudinal side walls 28 and 29, so that the carrying strap 350 can serve as a strap or carrying handle suitable for hanging on a shoulder in a central portion of the longitudinal side wall 26.

| | | | |
|---|---|---|---|
| 10 | suction device 9 stack | 60 | closure element |
| 11 | suction turbine | FS | release position |
| 12 | suction inlet suction hose SL | V | locking position |
| 13 | filter element | 61 | closure body |
| 14 | lower side | 62 | bearing swivel axis SC |
| 15 | upper side | 63 | bearing projection |
| 16 | long side in front - front side | 63A | rear gripping contour |
| 17 | long side at the back | 64 | bearing receptacle |
| 18 | long side with operating elements | 65 | arm body (65) |
| 19 | long side on the dust collecting chamber | 66 | upper side |
| 20 | suction device housing | 67 | locking element receptacle |
| 20A | stack housing | 68 | supply receptacle |
| 21 | dust collection chamber | 69 | circumferential wall of 68 |
| 22 | air outlet | 70 | bottom of 68 |
| 23 | housing interior | 71 | circumferential wall of 12 |
| 24 | suction turbine part | 72 | circumferential wall of 61 |
| 25 | bottom wall | 73 | bottom of 61 |
| 26 | long side wall in front | 74 | handle portion grip handle 74A |
| 27 | long side wall on the back | 75 | base wall |

-continued

| | |
|---|---|
| 28 | long side wall with control elements |
| 29 | long side wall dust collection chamber |
| 30 | intermediate wall |
| 31 | suction turbine receiving space |
| 31A | side wall |
| 32 | flow-through opening |
| 33 | |
| 34 | covering wall |
| 35 | receiving compartment |
| 36 | dust collecting container |
| 37 | bottom wall |
| 38 | side walls |
| 39 | side wall |
| 40 | filter receptacle |
| 41 | receptacle opening top |
| 42 | carrying handle swivel bearing 42A |
| 43 | interior of 36 |
| 44 | housing lower part |
| 45 | cover upper side 45A SD and OD |
| 46 | cover wall/cover body |
| 47 | suction turbine portion |
| 48 | closure portion |
| 49 | Seal |
| 50 | locking device |
| 51 | locking element/swivel bolt |
| 52 | locking element/protrusion |
| 53 | swivel bearing for cover |
| 54 | feet at back on housing 20 |
| 55 | feet at front on housing 20 |
| 56 | rear feet receptacle |
| 57 | front feet receptacle |
| 58 | coupling means |
| SR | stack axis |
| 59 | locking element below = 52 |
| S | suction flow |
| 11A | suction turbine inflow opening |
| 11B | suction turbine outflow openings |
| 11C | Fan |
| 11D | drive motor |
| 11E | Seal |
| 11F | suction turbine bearing element |
| 200 | container attachment |
| 200A | stacking container |
| 220 | Housing |
| 221 | side passage for SL |
| 222 | base passage for suction SL |
| 223 | 76 receiving space |
| 224 | handle grip |
| 225 | bottom wall |
| 226 | longitudinal side wall in front |
| 227 | longitudinal side wall to the rear |
| 228 | longitudinal side wall on the left |
| 229 | longitudinal side wall on the right |
| 251 | locking element/swivel bolt |
| 259 | locking element below = 52 |

| | |
|---|---|
| 76 | side walls |
| 77 | seal 74A sealing projections |
| 78 | |
| 80 | power supply device |
| 81 | energy storage receptacle |
| 82 | insertion opening |
| 83 | side wall to 28 |
| 84 | side wall to 30 |
| 85 | connecting wall above |
| 86 | connecting wall below |
| 87 | bottom wall |
| 88 | control space above |
| 89 | control space below |
| 90 | device interfaces |
| 91 | longitudinal guide contour plug-in axis SA |
| 91A | rear gripping contours |
| 92 | latching device |
| 93 | latching receptacle |
| 94 | contact arrangement |
| 95 | power supply contacts |
| 96 | data contacts |
| 97 | receptacle outflow opening at 83 outside |
| 97A | duct inflow opening for 100 |
| 98 | receptacle outflow opening at 84 inside |
| 98A | duct inflow opening for 99 |
| 99 | cooling air duct for 84 through 30 |
| 100 | cooling air duct for 83 |
| 101 | cooling air duct labyrinth |
| 102 | duct inflow opening |
| 102A | protective grille |
| 103A | duct portion rear 105 |
| 103B | common duct portion |
| 104 | hose receptacle |
| 105 | plug-in receptacle for hose |
| 106 | air guiding surface |
| 107 | Wall |
| 108 | duct outflow opening at 32 |
| 109 | Receptacle |
| 110 | cooling air hose |
| 110A | tubular body |
| 111 | inlet opening |
| 112 | hose portion arcuate |
| 113 | end portion |
| 140 | energization device |
| 141 | semiconductor elements |
| 142 | circuit board |
| 143 | Lines |
| 144 | lines to 11 |
| 150 | Controller |
| 151 | Processor |
| 152 | Storage |
| 153 | control programs |
| 154 | sensor on 11/pressure sensor |
| 155 | control element |
| 156 | control panel |
| 157 | Display |
| 158 | output means loudspeaker |
| 170 | energy storage |
| 171 | energy storage housing |
| 172 | longitudinal side wall |
| 172A | longitudinal sides |
| 173 | end side wall plug-in direction at the front |
| 174 | end side wall plug-in direction to the rear |
| 175 | bottom wall |
| 176 | interface wall |
| 177 | interior space |
| 178 | battery cells |
| 179 | fan (179) cooling air flow (KLA, KLB, KLC) KL |
| 180 | energy storage inflow opening |
| 181 | energy storage outflow opening |

-continued

| | | | |
|---|---|---|---|
| 300 | fastening receptacle | 182 | |
| 301 | | 183 | |
| 302 | rear gripping contour lengthwise | 190 | energy storage interface (190A, 190B) |
| 303 | rear gripping contour bottom | 191 | longitudinal guide contours |
| 304 | Bolts | 191A | rear gripping contours |
| 305 | operating surface | 192 | latching device |
| | | 193 | latching projection |
| 320 | fastening receptacle | 194 | contact arrangement |
| 322 | rear gripping contours | 195 | power supply contacts |
| 323 | rear gripping contour bottom | 196 | data contacts |
| 324 | locking contour | 197 | control element for 192 |
| 325 | locking element | 198 | |
| 340 | fastening devices | | |
| 341 | base body | | |
| 342 | rear gripping contour lengthwise | | |
| 343 | rear gripping contour in front | | |
| 344 | rear gripping contour on the back | | |
| 345 | operating surface | | |
| 346 | Bolts | | |
| 347 | strap receptacle | | |
| 348 | plug-through opening | | |
| 350 | carrying strap | | |
| 351 | length adjustment device | | |

What is claimed is:

1. A suction device with a suction device housing in which a suction turbine for generating a suction flow is arranged, the suction turbine having a suction turbine inflow opening through which the suction flow flows into the suction turbine, and at least one suction turbine outflow opening through which the suction flow can flow out of the suction turbine, the suction device housing having a suction inlet for letting in the suction flow and a dust collecting chamber for collecting dust contained in the suction flow, wherein a filter element for retaining dust in the dust collecting chamber is arranged between the dust collecting chamber and the suction turbine inflow opening of the suction turbine, and wherein the suction turbine inflow opening of the suction turbine is connected to at least one cooling air duct, which has a duct inflow opening, via which the cooling air from an area surrounding the suction device can flow past the filter element to the suction turbine.

2. The suction device of claim 1, wherein a flow cross section and/or the duct inflow opening of the at least one cooling air duct is permanently open.

3. The suction device of claim 1, wherein the duct inflow opening of the at least one cooling air duct is arranged on an outer wall of the suction device housing, and/or wherein a protective grille is arranged on the duct inflow opening.

4. The suction device of claim 1, wherein the duct inflow opening and/or an air outlet through which the suction flow can flow out of the suction device housing are/is arranged on side walls of the suction device housing, which extend between a bottom wall and a top wall of the suction device housing.

5. The suction device of claim 1, wherein the at least one cooling air duct has a duct portion which, in order to cool an electrical component separate from the suction turbine, passes by the electrical component.

6. The suction device of claim 1, further comprising an energy storage receptacle for an electrical energy storage which can be detachably connected to the suction device and on which a device interface is arranged with a contact arrangement for establishing an electrical connection to the electrical energy storage.

7. The suction device of claim 6, wherein the duct inflow opening of the at least one cooling air duct is arranged on the energy storage receptacle, so that cooling air can flow past the energy storage received in the energy storage receptacle into the duct inflow opening.

8. The suction device of claim 6, wherein the at least one energy storage has a fan for generating a cooling air flow that cools the energy storage, an energy storage housing of the energy storage having an energy storage inflow opening for the inflow of the cooling air flow into an interior of the energy storage housing and an energy storage outflow opening for the outflow of the cooling air flow from the interior of the energy storage housing.

9. The suction device of claim 8, wherein the duct inflow opening of the at least one cooling air duct is arranged on the energy storage receptacle in such a way that the energy storage outflow opening of the energy storage is directly opposite to the duct inflow opening when the energy storage is arranged in the receptacle of the suction device.

10. The suction device claim 8, wherein the energy storage inflow opening of the energy storage is arranged in the region of an insertion opening of the energy storage receptacle for inserting the energy storage into the energy storage receptacle, when the energy storage is arranged in the energy storage receptacle.

11. The suction device of claim 10, wherein the duct inflow opening of the at least one cooling air duct is arranged on a longitudinal end region of the energy storage receptacle opposite to the insertion opening.

12. The suction device of claim 6, wherein the duct inflow opening of the at least one cooling air duct is arranged directly next to the contact arrangement of the device interface of the energy storage receptacle.

13. The suction device of claim 1, further comprising a tubular body, in which the at least one cooling air duct runs at least in portions, or which provides the cooling air duct.

14. The suction device of claim 13, wherein the tubular body runs past and/or penetrates a suction turbine receiving space, in which the suction turbine is received, and/or at an energy storage receptacle, on which at least one energy storage can be arranged for the power supply of the suction device.

15. The suction device of claim 1, wherein the suction turbine inflow opening is arranged on a wall of a suction turbine receiving space in which the suction turbine is arranged and which is fluidly connected to an air outlet or has an air outlet, wherein the suction flow generated by the suction turbine and the cooling air flow of the at least one cooling air duct can flow out via the air outlet.

16. The suction device of claim 1, further comprising at least two cooling air ducts, of which each cooling air duct has a separate duct inflow opening and/or separate duct outflow opening.

17. The suction device of claim 1, further comprising at least two cooling air ducts which have separate duct inflow openings or separate duct outflow openings and at least one common duct portion.

18. The suction device of claim 1, wherein the at least one cooling air duct opens out at an outflow opening which is arranged between the filter element and the suction turbine inflow opening, and/or wherein at least two cooling air ducts have separate outflow openings via which cooling air can flow from the respective cooling air duct to the suction turbine inflow opening.

19. The suction device of claim 1, further comprising at least two cooling air ducts, which have different flow cross sections.

20. The suction device of claim 1, further comprising a controller for controlling the suction turbine, the controller being configured for determining a volume flow of the suction flow and/or a flow rate of the suction flow based on a motor characteristic of a drive motor of the suction turbine, the motor characteristic showing a current curve of the drive motor as a function of a supply voltage applied to the drive motor.

21. The suction device of claim 20, wherein the motor characteristic in the area of the volume flow to be determined and/or of the flow rate of the suction flow to be determined has a changing and/or essentially linear profile due to the cooling air permanently flowing in via the at least one cooling air duct.

22. The suction device of claim 20, wherein the controller is configured to output at least one acoustic and/or visual warning if the motor characteristic falls below a predetermined threshold value which corresponds to a minimum volume flow and/or a minimum flow rate of the suction flow.

23. The suction device of claim 1, wherein the suction turbine is or can be cooled by the suction flow it conveys and/or is a flow-through turbine.

24. The suction device of claim 1, wherein the suction device housing is configured as a stacking housing designed to form a housing stack extending in the direction of a stacking axis.

25. The suction device of claim 24, further comprising has-coupling means for coupling the suction device housing to a stacking container stacked over or stacked under it along the stacking axis, the coupling means being configured to interact with coupling means of the stacking container, so that the suction device housing is firmly connected with the stacking container by means of the coupling means transversely to the stacking axis and parallel to the stacking axis.

26. The suction device of claim 24, further comprising a container attachment which can be stacked along the stacking axis as a stacking container on the suction device housing.

* * * * *